US009233733B2

(12) United States Patent
Bein et al.

(10) Patent No.: US 9,233,733 B2
(45) Date of Patent: Jan. 12, 2016

(54) MAST STABILIZING DEVICE

(71) Applicants: Thomas W. Bein, Gambrills, MD (US); Charles E. Engstrom, Pasadena, MD (US); Mark S. Rice, Brinklow, MD (US)

(72) Inventors: Thomas W. Bein, Gambrills, MD (US); Charles E. Engstrom, Pasadena, MD (US); Mark S. Rice, Brinklow, MD (US)

(73) Assignee: MARITIME APPLIED PHYSICS CORPORATION, Baltimore, MD (US)

( * ) Notice: Subject to any disclaimer, the term of this patent is extended or adjusted under 35 U.S.C. 154(b) by 78 days.

(21) Appl. No.: 13/958,004

(22) Filed: Aug. 2, 2013

(65) Prior Publication Data

US 2015/0033999 A1 Feb. 5, 2015

(51) Int. Cl.
*B63B 15/00* (2006.01)
*B63B 15/02* (2006.01)

(52) U.S. Cl.
CPC ..... *B63B 15/02* (2013.01)

(58) Field of Classification Search
USPC ..... 114/91, 90
IPC ..... B63B 2015/0066,15/02
See application file for complete search history.

(56) References Cited

U.S. PATENT DOCUMENTS 3,674,225 A 7/1972 Johnson
4,016,823 A * 4/1977 Davis ..... 114/90
4,736,205 A 4/1988 Dodge
5,116,268 A 5/1992 Eninger et al.
5,280,760 A * 1/1994 Edwards ..... 114/39.15
5,560,310 A * 10/1996 Christensen et al. ..... 114/91
6,378,449 B1 * 4/2002 Leblanc et al. ..... 114/91
6,789,489 B1 * 9/2004 Phipps ..... 114/39.24
6,805,065 B1 * 10/2004 Reynolds ..... 114/91
8,004,472 B2 8/2011 Su

OTHER PUBLICATIONS

International Search Report and Written Opinion for PCT/US14/49340 dated Apr. 22, 2015; 10 pages.
Briguglio, "Antenna Stabilizing Buoy", United State Statutory Invention Registration H1051, May 5, 1992, 6 pages.

* cited by examiner

*Primary Examiner* — Stephen Avila
(74) *Attorney, Agent, or Firm* — Loza & Loza, LLP; S. Sean Thavonekham

(57) ABSTRACT

Some implementations feature a mast stabilizing device that includes a mast comprising a first portion and a second portion, a sensor coupled to the first portion of the mast, and a pivot structure coupled to the mast. The pivot structure is configured to allow the mast to pivot in the mast stabilizing device. The mast is coupled to the pivot structure so as to pivot along a pivot portion of the mast. The mast stabilizing device also includes a mass coupled to the second portion of the mast. The mass is configured to counteract a force applied to the first portion of the mast. The mast stabilizing device further includes a platform coupled to the pivot structure, the platform configured to operate on a body of water. In some implementations, the pivot structure is a gimbal device.

32 Claims, 24 Drawing Sheets

MAST STABILIZING DEVICE

BACKGROUND

1. Field

Various features relate to a mast stabilizing device.

2. Background

Masts are used to hold antennas or sensors aloft in terrestrial (e.g., ground) applications. The range of a sensor attached to a mast is limited by the height of the mast itself. As a result, a higher/longer mast results in a longer range of the sensor. The mast can be a single piece or can be constructed from telescoping sections. Masts are subject to various forces. One type of force that a mast is subject to is wind (e.g., wind loading). Wind loading produces a moment that must be reacted. Typically, the longer the mast, the higher the force (e.g., from wind loading) that may be applied on the mast. FIG. 1 conceptually illustrates how a force (e.g., from wind) may be applied on a mast. As shown in FIG. 1, a mast 100 is coupled to a ground 102. The mast 100 is further coupled to a sensor 104. A force is applied through the length of the mast 100 and the sensor 104. This force may be a force from wind loading. This force produces a moment at the point where the mast 100 and the ground 102 are coupled.

To counteract and/or react to the moment that is generated, a mast, shown in FIG. 2, may be built in a guy-wired supported system 200 or a freestanding structure 202. In a guy-wire supported system, the mast is only required to react to the vertical load. This approach has an advantage in that the mast can be a much simpler structure than a freestanding structure (e.g., freestanding tower). The primary disadvantage of a guy-wired system over a freestanding structure is the large ground area required for the guy wires. Although the freestanding structure requires less ground area than a guy-wire supported mast, the freestanding structure requires a significant foundation, such as poured concrete footers, to react to the wind load generated moment.

Sensors mounted on terrestrial (e.g., ground) type masts attached to moving platforms, such as a ship, suffer signal degradation due to the motion. That is, the data captured by the sensor attached to a moving platform can be inaccurate. There are means that can be used, such as gyroscopically stabilized platforms, to counter act the motion of the platform. FIG. 3 illustrates an example of a gyroscopically stabilized platform 300 known in the art. A gyroscopically stabilized system can provide precise positioning for high gain antennas, but such systems consume power and have a higher failure rate than a purely passive system. In addition, gyroscopically stabilized systems have higher costs than purely passive systems.

Therefore, there is a need for a mast stabilizing device that can reduce/minimize the effects of motion on a mast coupled to a moveable platform and/or moveable structure, such as boats, ships, or buoys.

DRAWINGS

Various features, nature and advantages may become apparent from the detailed description set forth below when taken in conjunction with the drawings in which like reference characters identify correspondingly throughout.

FIG. 1 conceptually illustrates how a force (e.g., from wind) may be applied on a mast.

SUMMARY

Figure 1:
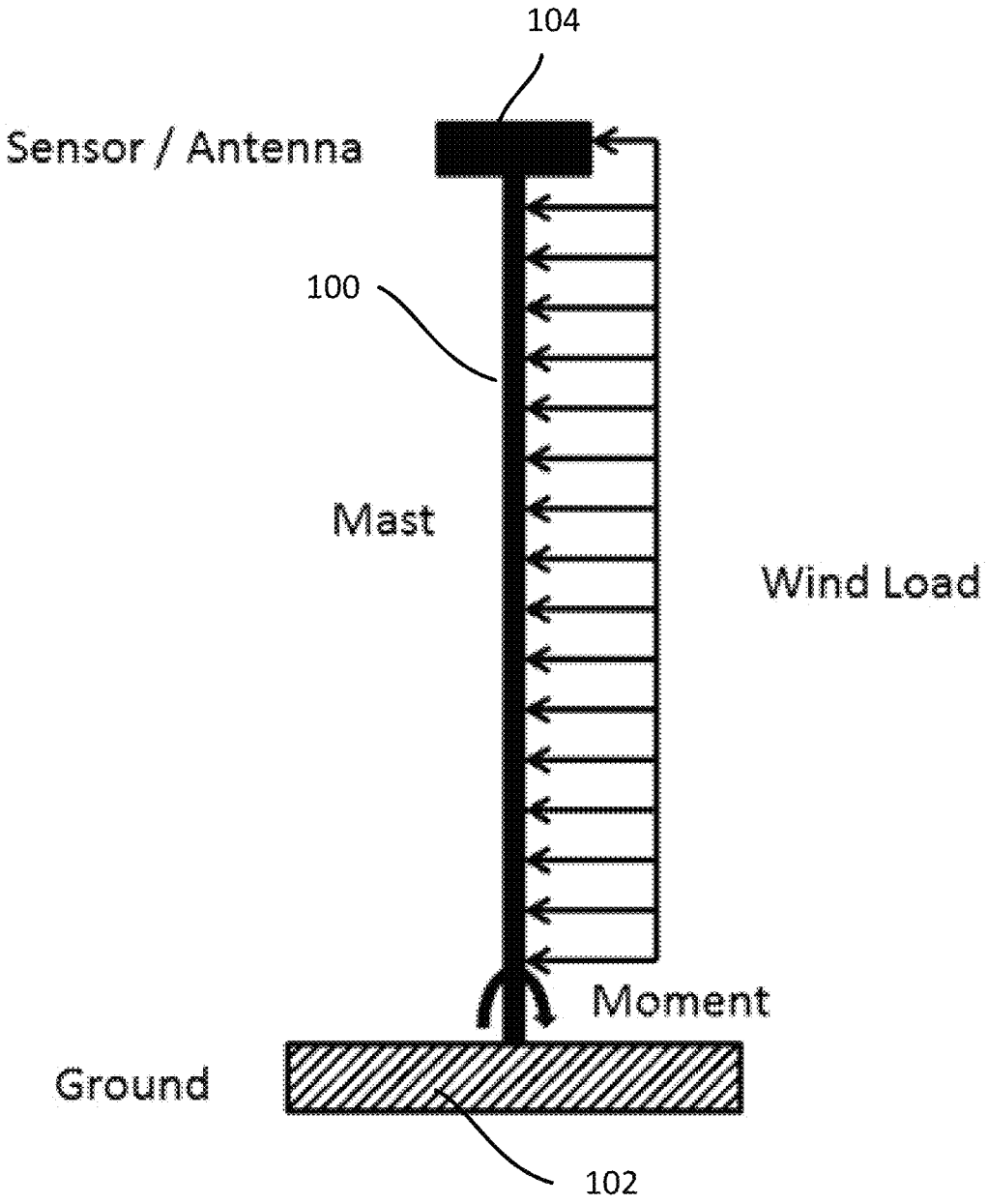
(PRIOR ART) FIG. 1
Figure 2:
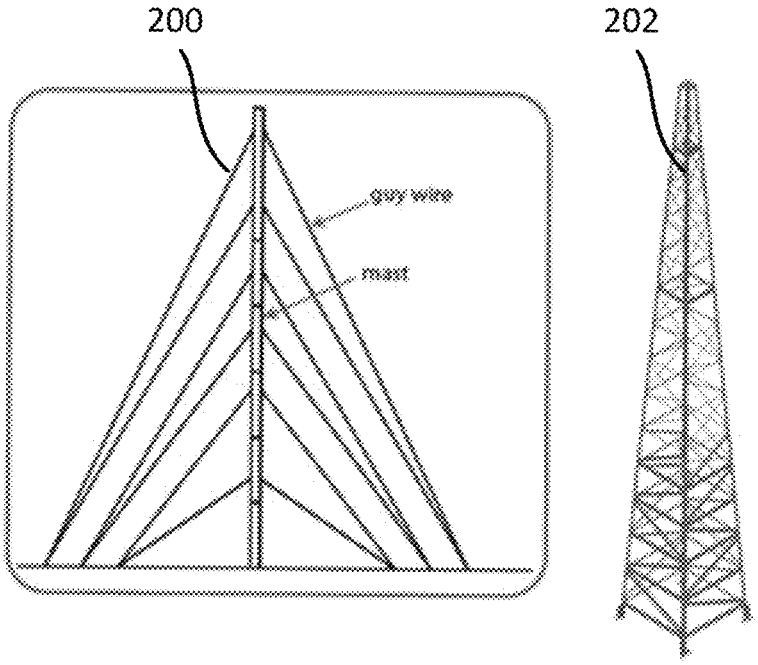
(PRIOR ART) FIG. 2
FIG. 2 illustrates examples of a mast in a guy-wired supported system and a mast in a freestanding structure.
Figure 3:
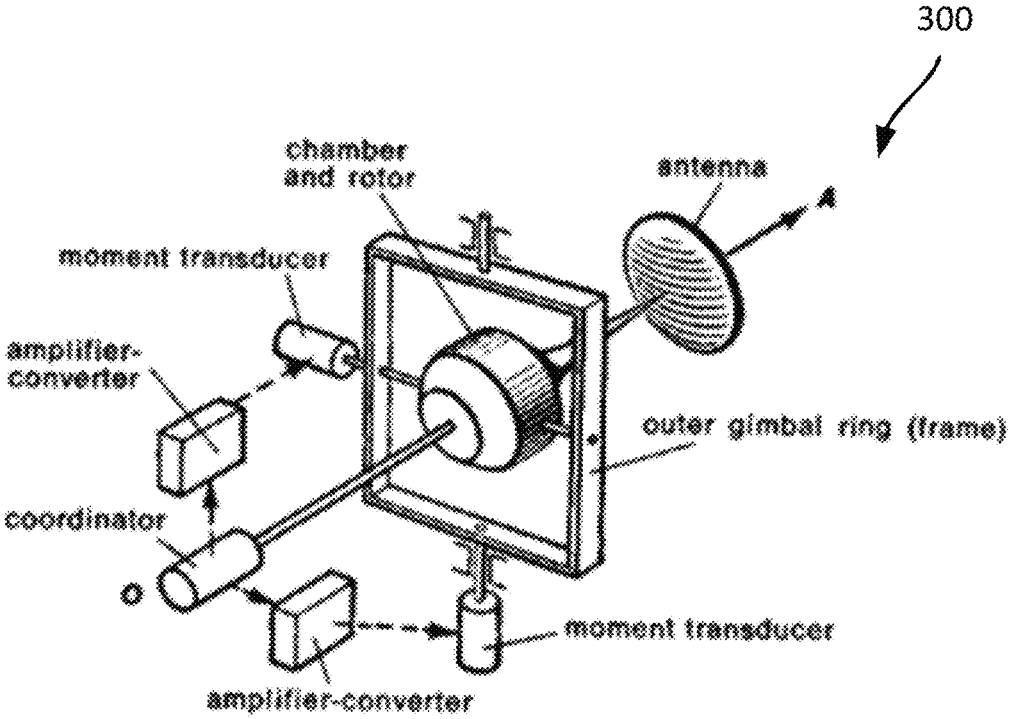
(PRIOR ART) FIG. 3
FIG. 3 illustrates an example of a gyroscopically stabilized platform.

Some implementations provide a mast stabilizing device that includes a mast, a pivot structure, a mass, and a platform. The mast includes a first portion and a second portion. The pivot structure is coupled to the mast. The pivot structure is configured to allow the mast to pivot in the mast stabilizing device. The mast is coupled to the pivot structure so as to pivot along a pivot portion of the mast. The mass is coupled to the second portion of the mast. The mass is configured to counteract a force applied to the first portion of the mast. The platform is coupled to the pivot structure. The platform is configured to operate on a body of water.

According to an aspect, the pivot structure is a gimbal device.

According to one aspect, the mass is configured to operate as a damping device when the mass is immersed in the body of water. The damping device is configured to limit a swinging motion of the mast.

According to an aspect, the platform is one of at least a surface buoy, and/or a moveable surface vessel.

According to one aspect, the mast stabilizing device further includes a lifting body coupled to the mast. The lifting body is configured to counteract force from wind on the mast.

According to an aspect, the mast is an extendable mast configured to position the mass further away from the pivot portion, when the extendable mast is in an extended position relative to a refracted position.

According to one aspect, the mast is a configurable mast that includes a pivot joint that is configured to allow at least a portion of the configurable mast to bend and/or be adjusted. The configurable mast is configured to be able to be adjusted in order to shift the mass in a different position relative to the mast.

According to one aspect, the mast is an extendable mast configured to position the mass further away from the pivot portion, when the extendable mast is in an extended position relative to a retracted position.

According to an aspect, the mass is coupled to the mast such that the mass is laterally shifted relative to the mast.

According to one aspect, the mast stabilizing device further includes a constant tension device coupled to the mast through a cable. The constant tension device and the cable are configured to counteract force from air and/or water on the mast.

According to an aspect, the mast stabilizing device further includes an adjustable spring coupled to the pivot structure and the mast. The adjustable spring is configured to operate as a damping device that limits a swinging motion of the mast.

According to one aspect, the mast stabilizing device further includes at least one deflector coupled to the platform. At least one deflector is configured to align the platform along a current in the body of water.

According to an aspect, the mast stabilizing device further includes a damping device that includes a spring. The damping device is coupled to the mast and the pivot structure.

According to one aspect, the mast stabilizing device further includes a carriage spring device that includes a spring. The carriage spring device is coupled to the mast and the pivot structure.

According to an aspect, the mast stabilizing device further includes a first rail coupled to the mast, a second rail coupled to the pivot structure, a first rail coupler coupled to the first rail, and a second rail coupler coupled to the second rail.

According to one aspect, the mast stabilizing device further includes a sensor coupled to the first portion of the mast. The mast is an extendable mast configured to position the sensor further away from the pivot portion when the extendable mast is in an extended position relative to a retracted position.

According to an aspect, the mass is configured to be laterally moveable relative to the mast.

According to one aspect, the mass includes an internal mass, the internal mass configured to be laterally moveable relative to the mast.

Some implementations provide an apparatus that includes a mast, a pivot means, a counterweight means, and a platform. The mast includes a first portion and a second portion. The pivot means is coupled to the mast. The pivot means is configured to allow the mast to pivot in the mast stabilizing device. The mast is coupled to the pivot means so as to pivot along a pivot portion of the mast. The counterweight means is coupled to the second portion of the mast. The counterweight means is configured to counteract a force applied to the first portion of the mast. The platform is coupled to the pivot means. The platform is configured to operate on a body of water.

According to an aspect, the pivot means is a gimbal device.

According to one aspect, the counterweight means is configured to operate as a damping means when the counterweight means is immersed in the body of water. The damping means is configured to limit a swinging motion of the mast.

According to an aspect, the platform is one of at least a surface buoy, and/or a moveable surface vessel.

According to one aspect, the apparatus further includes a lifting means coupled to the mast. The lifting means is configured to counteract force from wind on the mast.

According to an aspect, the mast is an extendable mast configured to position the counterweight means further away from the pivot portion, when the extendable mast is in an extended position relative to a retracted position.

According to one aspect, the mast is a configurable mast that includes a pivot joint means that is configured to allow at least a portion of the configurable mast to bend and/or be adjusted. The configurable mast is configured to be able to be adjusted in order to shift the mass in a different position relative to the mast.

According to an aspect, the counterweight means is coupled to the mast such that the counterweight means is laterally shifted relative to the mast.

According to one aspect, the apparatus further includes a constant tension means coupled to the mast through a cable. The constant tension means and the cable are configured to counteract force from one of at least air and/or water on the mast.

According to an aspect, the apparatus further includes an adjustable spring means coupled to the pivot means and the mast. The adjustable spring is configured to operate as a damping means that limits a swinging motion of the mast.

According to one aspect, the apparatus further includes at least one deflecting means coupled to the platform. The deflecting means is configured to align the platform along a current in the body of water.

According to an aspect, the apparatus further includes a damping means that includes a spring. The damping means is coupled to the mast and the pivot means.

According to one aspect, the apparatus further includes a carriage spring means that includes a spring. The carriage spring means is coupled to the mast and the pivot means.

According to an aspect, the apparatus further includes a first rail coupled to the mast, a second rail coupled to the pivot means, a first rail coupler coupled to the first rail, and a second rail coupler coupled to the second rail.

According to one aspect, the apparatus further includes a sensor coupled to the first portion of the mast. The mast is an extendable mast configured to position the sensor further away from the pivot portion when the extendable mast is in an extended position relative to a retracted position.

According to an aspect, the mass is configured to be laterally moveable relative to the mast.

According to one aspect, the mass includes an internal mass, the internal mass configured to be laterally moveable relative to the mast.

DETAILED DESCRIPTION

In the following description, specific details are given to provide a thorough understanding of the various aspects of the disclosure. However, it will be understood by one of ordinary skill in the art that the aspects may be practiced without these specific details.

Overview

Some implementations feature a mast stabilizing device that includes a mast comprising a first portion and a second portion, a sensor coupled to the first portion of the mast, and a pivot structure coupled to the mast. In some implementations, the first portion of the mast includes a top portion of the mast that is configured to be exposed to wind. In some implementations, the second portion of the mast includes a bottom portion of the mast that is configured to be submerged in a body of water. The pivot structure is configured to allow the mast to pivot in the mast stabilizing device. The mast is coupled to the pivot structure so as to pivot along a pivot portion of the mast. The mast stabilizing device also includes a mass coupled to the mast. The mass is configured to counteract a force applied to the first portion of the mast. The mast stabilizing device further includes a platform coupled to the pivot structure, the platform configured to operate on a body of water. In some implementations, the pivot structure is a gimbal device. In some implementations, the mass is configured to operate as a damping device when the mass is immersed in the body of water. The damping device is configured to limit a swinging motion of the mast. In some implementations, the platform is a surface buoy. In some implementations, the mast stabilizing device further includes a lifting body coupled to the mast. The lifting body is configured to counteract force from wind on the mast. In some implementations, the mast is an extendable mast (e.g., telescopic mast) configured to position the mass further away from the pivot portion, when the extendable mast is in an extended position relative to a refracted position. In some implementations, the mast stabilizing device further includes a constant tension device (e.g., constant tension winch) coupled to the mast through a cable. The constant tension device and the cable are configured to counteract force from wind on the mast. In some implementations, the mast stabilizing device also includes an adjustable spring coupled to the pivot structure and the mast. The adjustable spring is configured to operate as a damping device that limits a swinging motion of the mast. In some implementations, the mast stabilizing device further includes at least one deflector coupled to the platform. The deflector is configured to align the platform along a current in the body of water.

Exemplary Mast Stabilizing Device

Figure 4:
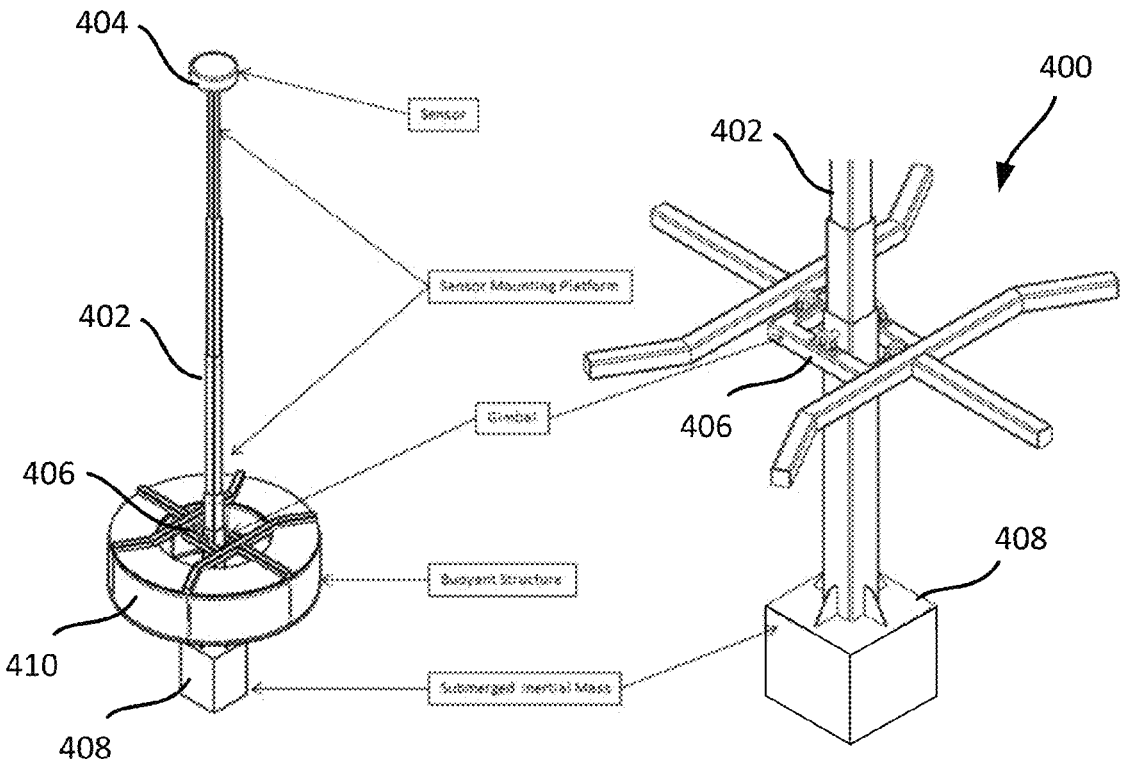
FIG. 4 illustrates an example of a mast stabilizing device.

FIG. 4 illustrates an example of a mast stabilizing device that may be used in some implementations. In some implementations, the mast stabilizing device may be used on a platform in a body of water (e.g., sea).

As shown in FIG. 4, the mast stabilizing device 400 includes a mast 402, a sensor 404, a pivot structure 406, a mass 408, and a platform 410. The mast 402 is coupled to the sensor 404. More specifically, a first portion (e.g., top portion) of the mast 402 is coupled to the sensor 404. In some implementations, the first portion (e.g., top portion) includes a portion of the mast 402 that is above a pivot point on the mast 402. In some implementations, the first portion (e.g., top portion) includes a portion of the mast 402 that is exposed to wind force/loading. In some implementations, the first portion includes a portion of the mast 402 above the platform 410. In some implementations, the first portion (e.g., top portion) of the mast 402 includes a portion of the mast 402 that is the highest point on the mast 402.

It should be noted that the sensor 404 is merely an example of an object and/or device that may be coupled to the mast 402. In some implementations, other objects and/or devices may be coupled to the mast 402 in lieu of or in addition to the sensor 404. Other objects and/or devices that may be coupled to the mast 402 include a transmitter, and/or a receiver. In some implementations, multiple sensors, objects and/or devices may be coupled to the mast 402.

As shown in FIG. 4, the mast 402 is coupled to the pivot structure 406. The pivot structure 406 may be a gimbal device in some implementations. In some implementations, the pivot structure 406 is a pivot means. In some implementations, the pivot structure 406 is configured to allow the mast 402 to pivot (e.g., rotate, swing) about a platform (e.g., platform 410). In some implementations, the pivot structure 406 is configured to allow a platform (e.g., platform 410) to pivot about the mast 402. In some implementations, the pivot structure 406 allows the mast 402 to rotate/swing about a pivot point in the mast 402. Different implementations may allow the mast 402 to rotate/swing along different ranges/angles and different directions. In some implementations, the pivot structure 406 (e.g., gimbal device) may limit the range of the rotation/swinging of the mast 402 along a certain direction (e.g., only along an x-direction, only along a y-direction). In some implementations, the pivot structure 406 may include one or more bearings to allow the rotation/swinging of the mast 402.

The pivot structure 406 is coupled to the platform 410. In some implementations, the platform 410 may be a moveable platform (e.g., vessel, ship, boat). In some implementations, the platform 410 may be a buoy. Different implementations may use platforms with different shapes and sizes. As such, the platform 410 illustrated in FIG. 4 and all the other platforms illustrated and described in the present disclosure are merely exemplary. Platforms may be designed and configured to accommodate different components and parts for the mast stabilizing device. For example, a platform may include structures and/or components to store batteries, circuit components, computers, sensors, transmitters, receivers, mechanical devices, electrical devices and/or other hardware necessary for the operation of the platform 410 and/or mast stabilizing device 400.

FIG. 4 also illustrates that the mast 402 is coupled to a mass 408. More specifically, a second portion (e.g., bottom portion) of the mast 402 is coupled to the mass 408. In some implementations, the second portion (e.g., bottom portion) includes a portion of the mast 402 that is below a pivot point on the mast 402. In some implementations, the second portion (e.g., bottom portion) includes a portion of the mast 402 that is submerged (e.g., partially or fully submerged) in a body of water. In some implementations, the second portion includes a portion of the mast 402 below the platform 410.

In some implementations, the mass 408 is a counterweight to the sensor 404. In particular, in some implementations, the combination of the second portion (e.g., bottom portion) of the mast 402 and the mass 408 is a counterweight to the first portion (e.g., top portion) of the mast 402 and the sensor 404. In some implementations, the mass 408 is configured to be submerged (e.g., partially or fully submerged) in water when the mast stabilizing device 400 is operational and/or positioned in a body of water (e.g., sea, ocean). Different implementations may use a mass 408 with different shapes and sizes. In some implementations, the mass 408 (e.g., counterweight) is designed and/or configured to provide motion damping and/or the limiting of the swinging/rotation of the mast 402. Such motion damping and/or limiting of the swinging of the mast 402 through the use of the mass 408 will be further described below when describing the shape, design and/or drag coefficient of mass 408 (e.g., counterweight) coupled to a mast in a mast stabilizing device.

One exemplary objective of the mast stabilizing device 400 is to provide a cost effective and reliable device and method of positioning sensors elevated above a water surface (e.g. sea surface) with minimized pitch and roll motions. Both of the aerial mast approaches described in the background above are suitable for fixed, land based applications. However, neither approach is appropriate for deep water marine applications where the mast is supported by a platform such as a vessel or surface buoy. The waves move the platform (e.g., vessel, buoy) creating pitching, rolling, and heaving motions. The wave induced motions create additional inertial forces that must be resisted by the foundation system. The mast with the guy wire approach could be used with gyroscopic stabilization of the sensor but, it would still require a prohibitively large base structure for attaching the support wires. Spar buoys significantly reduce the pitching and rolling motion of the surface platforms but, must be very long in order to react the moment created by the sensor mounted on top of the tower. The combination of the spar buoy and the tower creates handling and deployment difficulties at sea due to the length of the assembly.

Rather than reacting to the moment with a large, fixed foundation or electrically powered gyroscopes, the mast stabilizing device 400 reacts to the moment with a counterbalance weight (e.g., mass 408) and the pivot device 406 (e.g., gimbal device). This has the advantage of reducing the size and mass of the foundation, thus reducing the cost and facilitating shipboard deployment. Additionally, the counterweight (e.g., mass 408) maintains the mast 402 in a vertical orientation (or near vertical orientation), even in a seaway. Moreover, the purely passive solution maximizes system energy efficiency.

Figure 5:
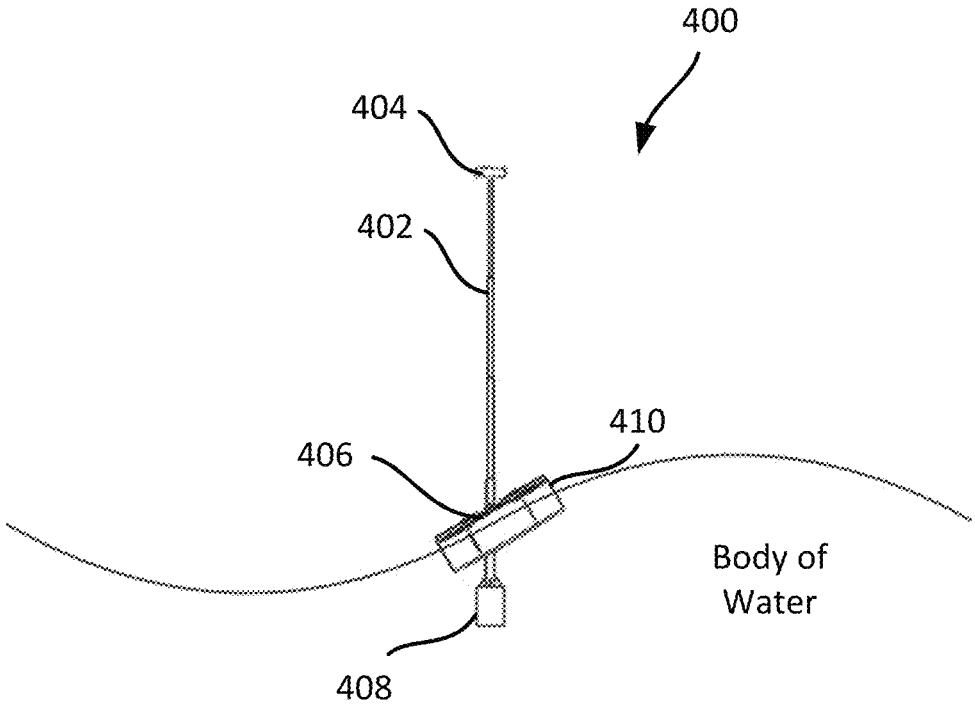
FIG. 5 illustrates an example of a mast stabilizing device in a body of water.

FIG. 5 illustrates how a mast stabilizing device 400 operates to reduce/minimize the motion of the sensor 404 when the mast stabilizing device is on a platform located in a body of water (e.g., sea, ocean). As shown in FIG. 5, the mass 408 (e.g., counterweight) hangs straight down while the platform 410 (e.g., buoy) pivots about the pivot structure 406 (e.g., gimbal device). This leaves the mast 402 vertical regardless of the roll or pitch of the platform 410 (e.g., buoy) in the body of water.

As further shown in FIG. 5, the mast 402, the pivot structure 406 (e.g., gimbal device), and the mass 408 (e.g., counterweight) form a pendulum. Very little motion from the body of water (e.g., seaway) is imparted from the platform 410 (e.g., buoy), through pivot structure 406 (e.g., the gimbal system) and into the mast 402. Although little motion may be imparted into the device, any motion will cause the pendulum system to start swinging.

Additionally, variable wind load (e.g., wind force) on the mast 402 and/or sensor 404 could cause pendulation. Because the system forms a pendulum, some form of motion damping may be further required. In some implementations, motion damping and/or limiting of rotation of the mast 402 may be provided by the viscous drag of the water on the mass 408 (e.g., counterweight). Thus, in some implementations, no additional damping system may be needed. To further increase the drag of the mass 408 and thus further increase the damping capability of the mass 408, features may be added to the mass 408 to increase the surface area of the mass 408. In some instance, it may be desirable to decrease the drag of the mass 408. This may be achieved by adding a deflector on the platform 410 (e.g., buoy) to align the mass 408 with the water current. An example of a deflector is further described below in FIG. 14.

As described above, the swinging motion of mast 402 may be dampened through the pivot structure 406 (e.g., through friction resistance). However, in some implementations (e.g., non-energy producing implementations), the pivot structure 406 is nearly frictionless, resulting in very little motion transmitted to the mast 402. Rather than allowing all of the pendulation energy to pass through the pivot structure 406, some of this energy can be captured and used by the mast stabilizing device 400. More specifically, in some implementations, power may be produced/generated by the mast stabilizing device 400 from the motion between the platform 410 (e.g., buoy) and the mast 402. In some implementations, the power generated from the motion may be used to provide a braking force to control the pendulation of the system (e.g., mast 402). In such an instance, a braking force can be applied within the pivot structure 406, allowing the mast 402 to incline relative to horizontal. This increases the potential energy of the system. When the incline of mast 402 has reached a desired angle, an electricity generator can be engaged, extracting some of the potential energy as gravity returns the mast 402 to vertical.

Having described a purpose and an advantage of a counterweight (e.g., mass 408) in the mast stabilizing device 400, the design, shape and/or property of the mass 408 (e.g., counterweight) will now be described below.

Exemplary Design, Shape and/or Drag Coefficient of Counterweight

One important property of the mass 408 (e.g., counterweight) is its drag coefficient. In some implementations, a drag coefficient is a dimensionless quantity that is used to quantify the drag or resistance of an object (e.g., mass 408) in a fluid environment (e.g., air, water). In some implementations, a lower drag coefficient indicates that the object (e.g., mass 408) will have less aerodynamic or hydrodynamic drag. Conversely, a higher drag coefficient indicates that the object (e.g., mass 408) will have more aerodynamic or hydrodynamic drag. The drag coefficient of an object (e.g., mass 408) is associated with a surface area and/or shape of the object (e.g., mass 408). Thus, different objects with different surface areas and/or shapes will have different drag coefficients.

In some implementations, the shape of the mass 408 is designed and/or configured to provide optimum motion damping of the mast 402. That is, in some implementations, the shape of the mass 408 is designed and/or configured to allow the mast 402 to swing like a pendulum with the motion of the body of water (e.g., sea) and/or wind, while at the same time, limiting how easily and/or at what angle the mast 402 may swing. When the mast 402 swings too easily, the sensor 404 coupled to the mast 402 may move unnecessarily, thus reducing the accuracy of the sensor 404 (e.g., accuracy of the data captured by the sensor 404). In some implementations, unnecessary motion of the sensor 404 may result in signal degradation.

In some implementations, the shape of the mass 408 (e.g., counterweight) is designed and/or configured to allow the mast 402 to swing only when the motion of the body of water and/or wind is above a certain threshold. For example, small motion in the wave and/or wind may not be enough to swing the mast 402 as the drag coefficient of the mass 408 in the body of water may be sufficiently high to prevent the mast 402 from swinging. In some implementations, such a design and/or configuration of the mass 408 may be desired to limit stress on the pivot structure 406 (e.g., bearings of the gimbal device) and thus extend the life of the pivot structure 406. Thus, in some implementations, the shape of the mass 408 is designed and/or configured to allow the mast 402 to swing when the motion of the body of water (e.g., wave) and/or the strength of the wind is high.

In addition, the shape of the mass 408 may be designed and/or configured to allow the mast 402 to move/swing more easily in a first direction (e.g., north-south direction), while limiting and/or restricting the swinging/motion of the mast 402 in a second direction (e.g., east-west). In another example, the shape of the mass 408 may be designed and/or configured to allow the mast 402 to move/swing more easily in a direction parallel to a current in the body of water, while limiting/restricting the motion/swinging of the mast 402 in a direction that is non-parallel (e.g., perpendicular, diagonal) to a current in the body of water. Thus, the shape of the mass 408 may be designed and/or configured to have different drag coefficients along different sides and/or surface areas of the mass 408. For example, a first side of the mass 408 may have a first drag coefficient, while a second side of the mass 408 may have a second drag coefficient that is different than the first drag coefficient (e.g., second drag coefficient may be greater than the first drag coefficient). In some implementations, the mass 408 may be configured to operate as a lifting body. As such, the mass 408 may have the shape of a lifting body in some implementations. Examples of lifting bodies are further described below (e.g., FIGS. 10A-10D and 11A-11D).

Examples of shapes for the mass 408 include spherical and non-spherical shapes. Non-spherical shapes may include half-spherical, cone, cube, wing and/or cylinder. In some implementations, the mass 408 may include one or more fins that protrude from the mass 408. In some implementations, these one or more fins may increase and/or decrease the drag coefficient of the mass 408 along a certain direction (e.g., first direction, second direction, direction perpendicular to current). In some implementations, these fins may be coupled to the mass 408 in such a way that the mass 408 may be configured to weather vane. In some implementations, weather vaning includes indicating the direction of wind and/or current of a body of water. In some implementations, weather vaning the mass 408 may be achieved by providing fins such that the surface area of the mass 408 with the fins is unequally divided over a pivot axis of the mass 408. For example, one or more fins may be coupled to the mass 408 such that the surface area of one side of the pivot axis of the mass 408 is greater than the surface area of another side of the pivot axis of the mass 408.

In some implementations, the mass 408 may be configured to provide storage functionality. That is, in some implementations, the mass 408 may be configured as a box and/or container capable of storing objects. Examples of such objects include batteries or any other device used in the operation of the mast stabilizing device. The use of the mass 408 as a storage device may be used in any of the mast stabilizing device described in the present disclosure.

Exemplary Mast Stabilizing Device that Includes Extendable Mast

Figure 6A:
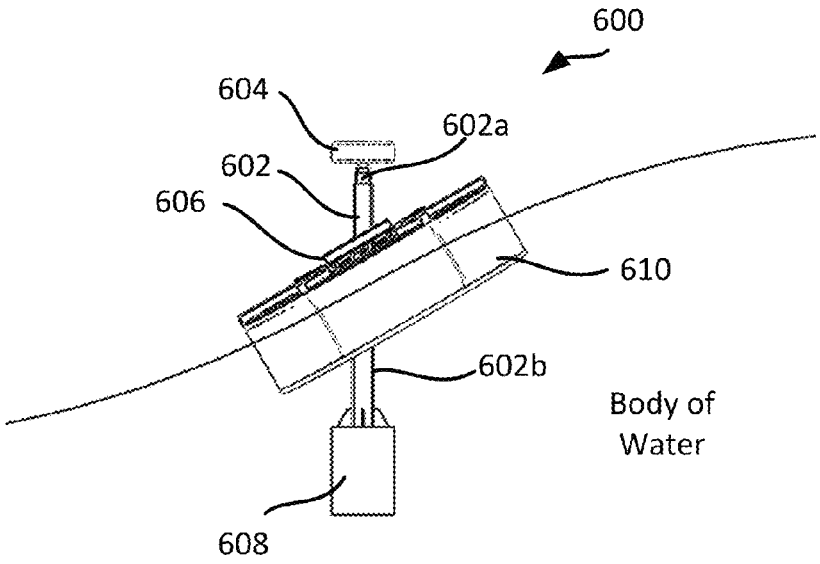
FIG. 6A illustrates an example of a mast stabilizing device that includes an extendable mast in a retracted position.
Figure 6B:
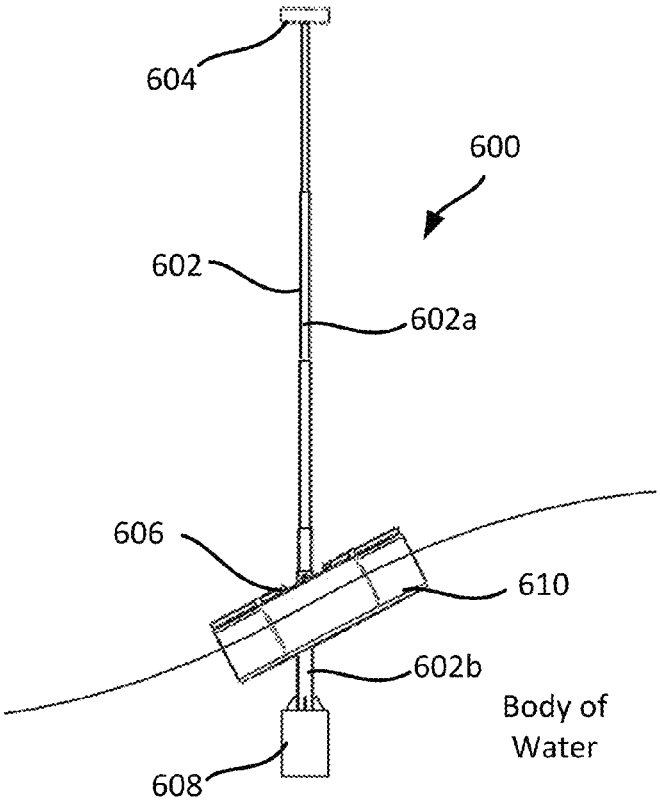
FIG. 6B illustrates an example of a mast stabilizing device that includes an extendable mast in an extended position.

FIGS. 6A-6B illustrate an example of a mast stabilizing device that includes an extendable mast. Specifically, FIG. 6A illustrates a mast stabilizing device with an extendable mast in a first position (e.g., retracted position) and FIG. 6B illustrates a mast stabilizing device with an extendable mast in a second position (e.g., extended position).

As shown in FIG. 6A, the mast stabilizing device 600 includes a mast 602, a sensor 604, a pivot structure 606, a mass 608, and a platform 610. The mast 602 includes a first portion 602*a* and a second portion 602*b*. The mast 602 is coupled to the sensor 604. More specifically, a first portion (e.g., top portion) of the mast 602 is coupled to the sensor 604. In some implementations, the first portion (e.g., top portion) of the mast 602 is a portion of the mast 602 that is above a pivot point on the mast 602, the pivot structure 606 and/or the platform 610.

The mast 602 is also coupled to the pivot structure 606. The pivot structure 606 may be a gimbal device in some implementations. In some implementations, the pivot structure 606 is configured to allow the mast 602 to pivot (e.g., rotate, swing) about a platform (e.g., platform 610). In some implementations, the pivot structure 606 is configured to allow a platform (e.g., platform 610) to pivot about the mast 602. The pivot structure 606 is coupled to the platform 610. In some implementations, the platform 610 may be a moveable platform (e.g., vessel, ship, boat). In some implementations, the platform 610 may be a buoy.

The mast 602 in FIG. 6A is an extendable mast. Different implementations may extend the mast 602 differently. The mast 602 may be extendable through telescopic means. That is the extendable mast 602 may be a telescoping mast. As shown in FIG. 6A, the mast 602 is in a first position. In the first position, the mast 602 is in a retracted position in some implementations. Specifically, FIG. 6A illustrates that a first portion 602*a* (e.g., top portion, portion configured to be exposed to wind, portion above pivot point) of the mast 602 is retracted.

FIG. 6B illustrates the mast stabilizing device with an extendable mast 602 in a second position. In some implementations, when the extendable mast 602 is in the second position, the extendable mast 602 is in an extended position. Specifically, FIG. 6B illustrates that the first portion 602*a* (e.g., top portion, portion configured to be exposed to wind) of the mast 602 is extended. Different implementations may extend and/or retract the mast 602 differently. In some implementations, a motor (not shown) may be used to extend and/or retract the mast 602 in different positions. In some implementations, a hydraulic mechanism or a pulley mechanism may be used to extend and/or retract the extendable mast 602.

Figure 7A:
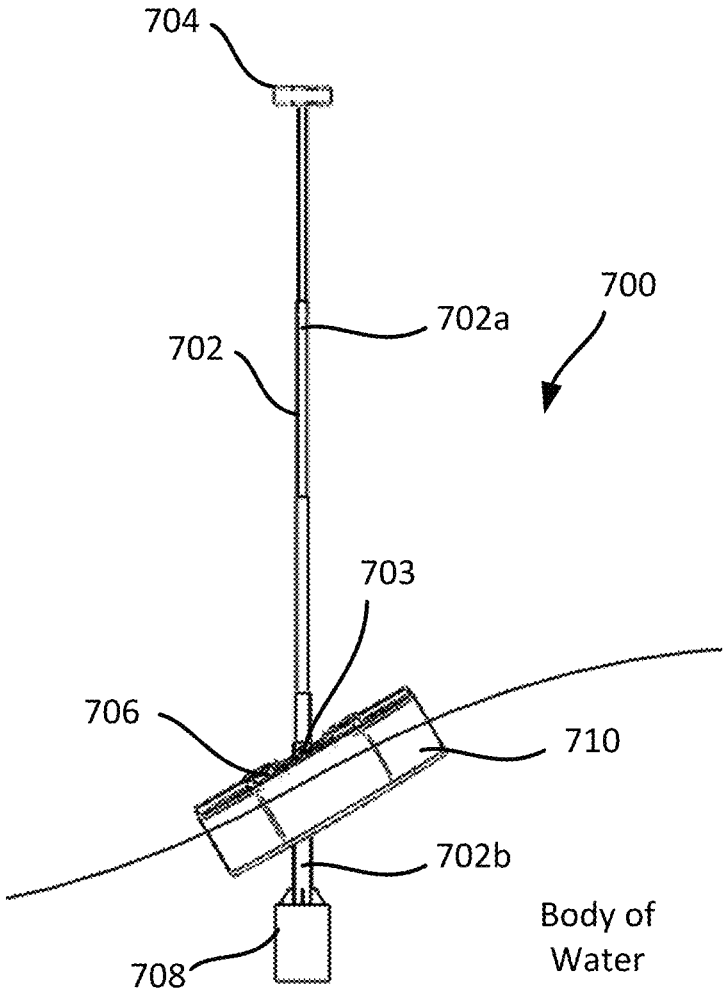
FIG. 7A illustrates an example of a mast stabilizing device that includes an extendable mast in a retracted position.
Figure 7B:
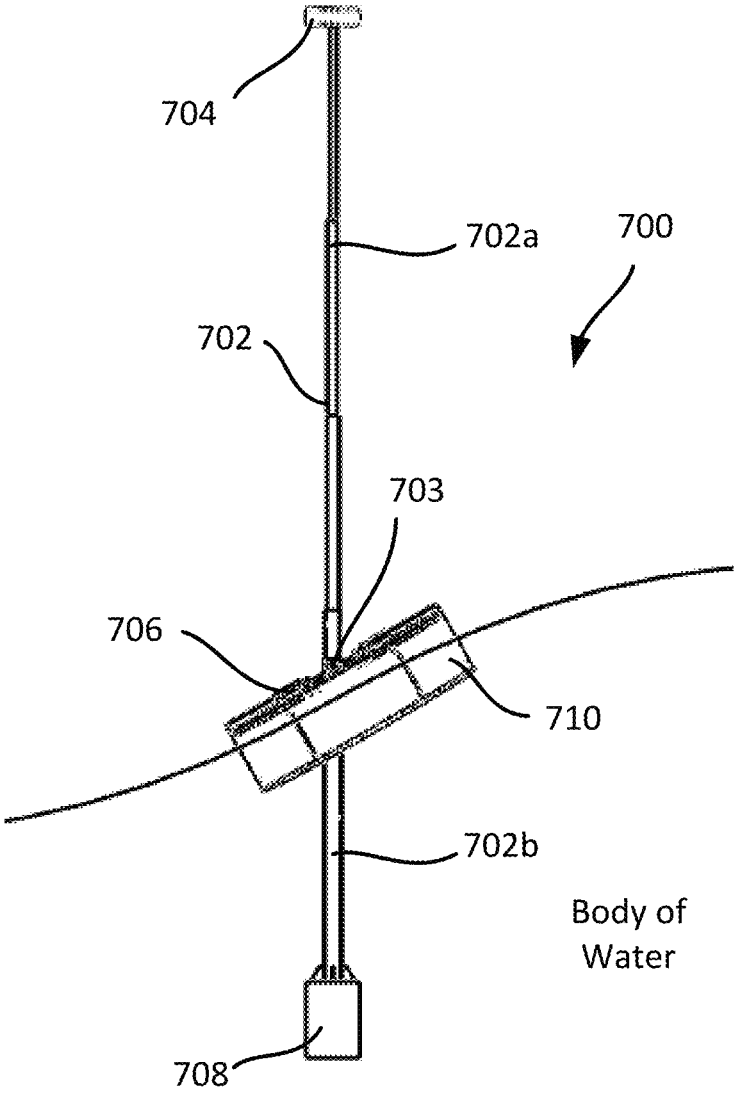
FIG. 7B illustrates an example of a mast stabilizing device that includes an extendable mast in an extended position.

FIGS. 7A-7B illustrate another example of a mast stabilizing device that includes an extendable mast. Specifically, FIG. 7A illustrates a mast stabilizing device with an extendable mast in a first position (e.g., retracted position) and FIG. 7B illustrates a mast stabilizing device with an extendable mast in a second position (e.g., extended position).

As shown in FIG. 7A, the mast 702 includes a first portion 702*a* and a second portion 702*b*. The second portion 702*b* (e.g. lower portion, portion configured to be submerged in a body of water, portion below a pivot point) of the mast 702 is in the refracted position, the mass 708 is positioned closest to the mast pivot point 703, the pivot structure 706, and the platform 710. In some implementations, it is desirable to increase the distance between the pivot structure 706 and the mass 708. FIG. 7B illustrates the mast stabilizing device with the second portion 702*b* of the extendable mast 702 in the extended position. In the extended position the mass 708 is deeper in the body of water than the mass 708 when the mast 702 is retracted, as shown in FIG. 7A. In some implementations, when the mass 708 is positioned farther away from the pivot point 703, the mast 702 is more resistant to wind force and thus less likely to move/swing due to the wind force. Although FIG. 7B illustrates the extendable mast 702 in one extended position (e.g., second position), in some implementations, the extendable mast 702 (e.g., 702*a*-702*b*) may have multiple extended positions (e.g., third position, fourth position) that position the mass 708 away from the pivot point along different distances. The length of the extension of the mast 702 may be dependent on the strength of the wind force in some implementations. For example, when there is more wind, the second portion 702*b* of the mast 702 may be extended further down than when there is less wind in some implementations.

Exemplary Mast Stabilizing Device that Includes Shiftable Counterweight

Figure 8A:
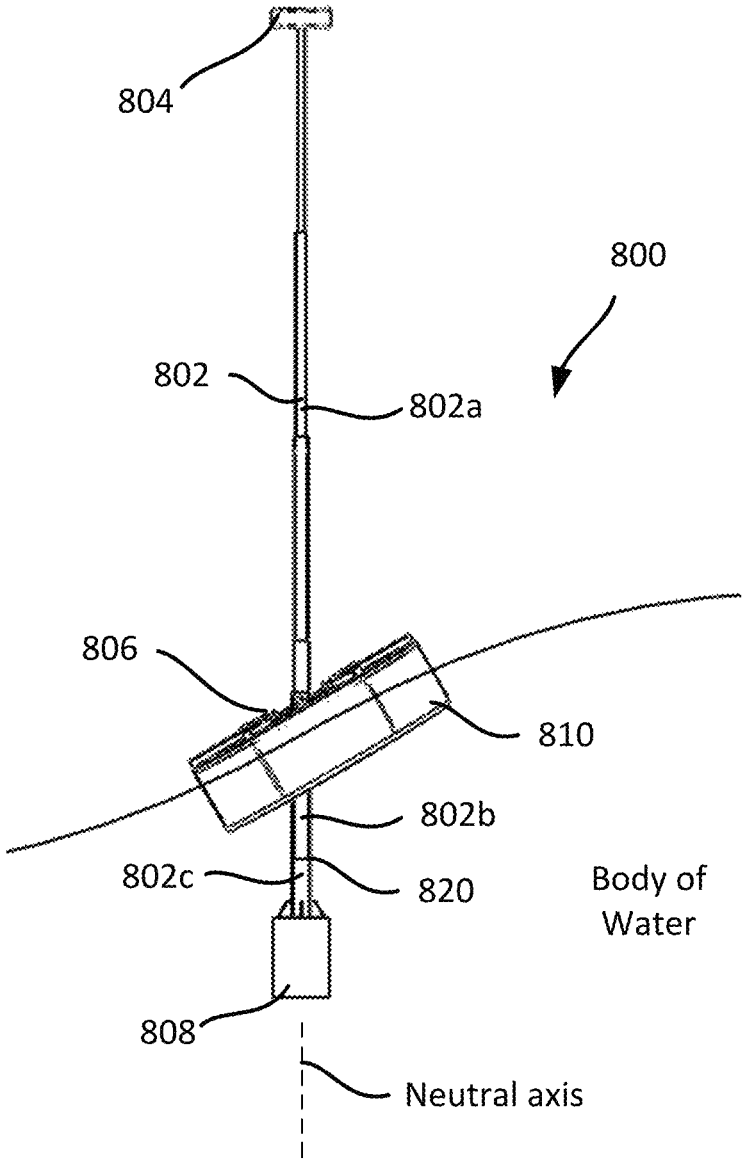
FIG. 8A illustrates an example of a mast stabilizing device that includes a mast in a neutral position.
Figure 8B:
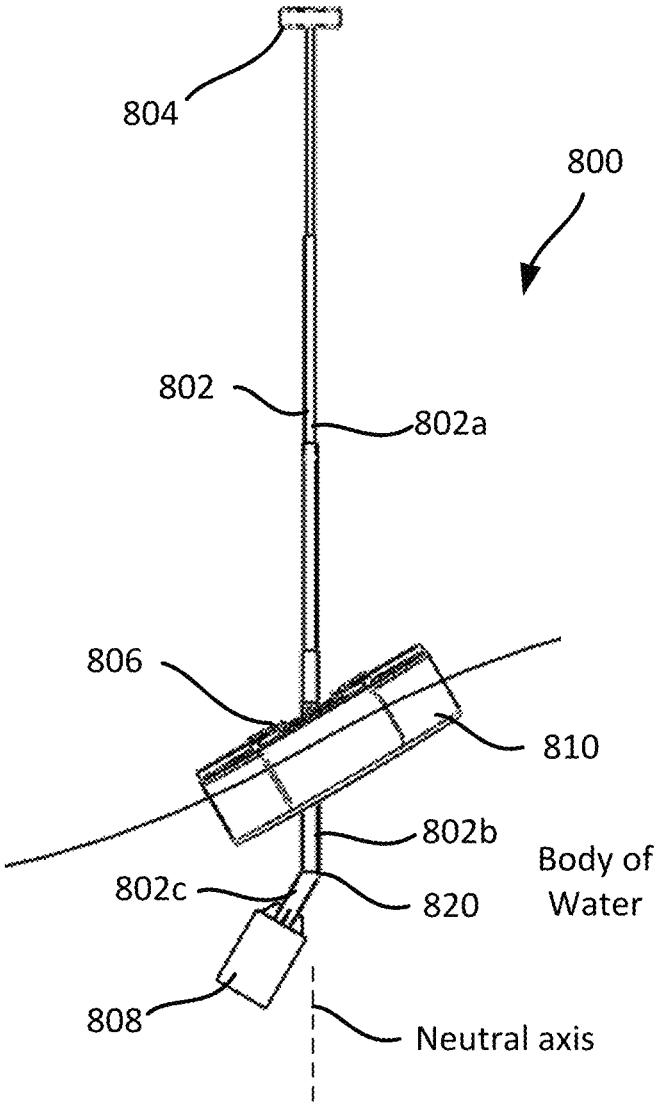
FIG. 8B illustrates an example of a mast stabilizing device that includes a mast in a bent position.

FIGS. 8A-8B illustrate an example of a mast stabilizing device that includes a shiftable counterweight. Specifically, FIG. 8A illustrates a mast stabilizing device with a mass 808 (e.g., counterweight) in a first position and FIG. 8B illustrates a mast stabilizing device with a mass 808 (e.g., counterweight) in a second rotational position (e.g., mass laterally and/or rotationally shifted) from a neutral position.

As shown in FIG. 8A, the mast stabilizing device 800 includes a mast 802, a sensor 804, a pivot structure 806, a mass 808, and a platform 810. The mast 802 is coupled to the sensor 804. More specifically, a first portion (e.g., top portion) of the mast 802 is coupled to the sensor 804. The mast 802 is also coupled to the pivot structure 806. The pivot structure 806 may be a gimbal device in some implementations. In some implementations, the pivot structure 806 is configured to allow the mast 802 to pivot (e.g., rotate, swing) about a platform (e.g., platform 810). In some implementations, the pivot structure 806 is configured to allow a platform (e.g., platform 810) to pivot about the mast 802. The pivot structure 806 is coupled to the platform 810. The platform 810 may be a buoy. In some implementations, the platform 810 may be a moveable platform (e.g., vessel, ship, boat).

In some implementations, the mast 802 is configured to allow the mass 808 to be rotationally shifted relative to the neutral position. Different implementations may position and configure the mast 802 differently. FIG. 8A illustrates the mast 802 is a configurable mast that includes a first portion 802*a*, a second portion 802*b*, a third portion 802*c*, and a pivot joint 820. In some implementations, a configurable mast is a mast that is capable of being adjusted in order to shift the mass 808 in a different position relative to the mast 802 (e.g., relative to neutral axis defined by the length of the mast 802 when the mast 802 is not bent). In this example, the configurable mast 802 may bend at the pivot joint 820. An example of the bending of the configurable mast 802 is described in FIG. 8B. FIG. 8A further shows that the first, second and third portions 802*a*-802*c* are all vertically aligned. As also shown in FIG. 8A, the mass 808 is in a first position. In the first position, the mass 808 is in a neutral position (e.g., no shifting from the neutral axis) in some implementations.

FIG. 8B illustrates the mast stabilizing device with a configurable mast 802 and the mass 808 in a second position. In some implementations, when the mass 808 is in the second position, the configurable mast 802 is in a bent position. That is, a portion of the configurable mast 802 bends about a pivot joint. In the example of FIG. 8B, the third portion 802*c* bends about the pivot joint 820 causing the third portion 802*c* to be shifted off the neutral axis. As shown in FIG. 8B, when the mast 802 is in the bent position, the mass 808 is rotationally shifted from a neutral position (e.g., along neutral axis defined along the length of the mast 802 when the mast 802 is not bent). Although FIG. 8B illustrates the configurable mast 802 in one bent position (e.g., second position), in some implementations, the configurable mast 802 may have multiple bent positions (e.g., third position, fourth position) that laterally and/or rotationally shift the position of the mass 808 from a neutral position along different distances and/or angles.

Different implementations may use different methods and mechanisms for shifting the mast 802 and/or bending the mast 802 along a pivot joint. In some implementations, an actuator and/or pulley mechanism may be used to shift the mass 808 to different lateral and/or rotational positions by changing the pivot angle of the configurable mast 802 along the pivot joint 820. The pivot joint 820 may include one or more hinge mechanisms. In some implementations, the mast 802 may include several pivot joints. In some implementations, the pivot joint 820 is a permanent pivot/bend in the mast 802.

Various wind and sea conditions will apply a lateral load to a first portion (e.g., top portion) of the configurable mast 802. By shifting the mass 808, the mast 802 can be maintained in a vertical orientation regardless of wind and/or sea conditions.

Exemplary Mast Stabilizing Device that Includes Shiftable Counterweight

Figure 9A:
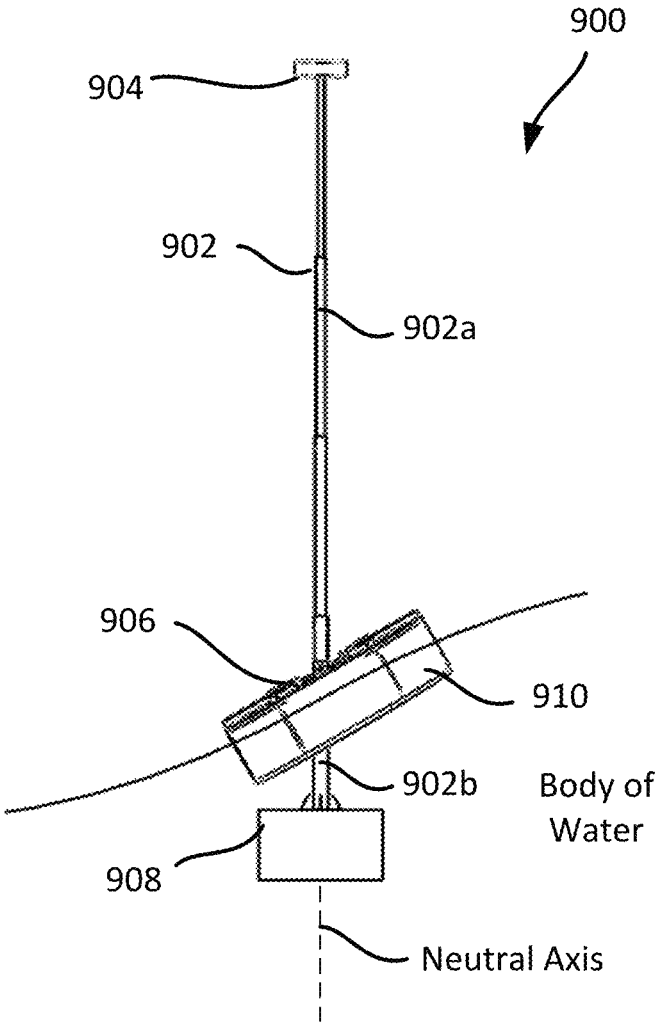
FIG. 9A illustrates an example of a mast stabilizing device that includes a mast coupled to a counterweight in an evenly balanced configuration.
Figure 9B:
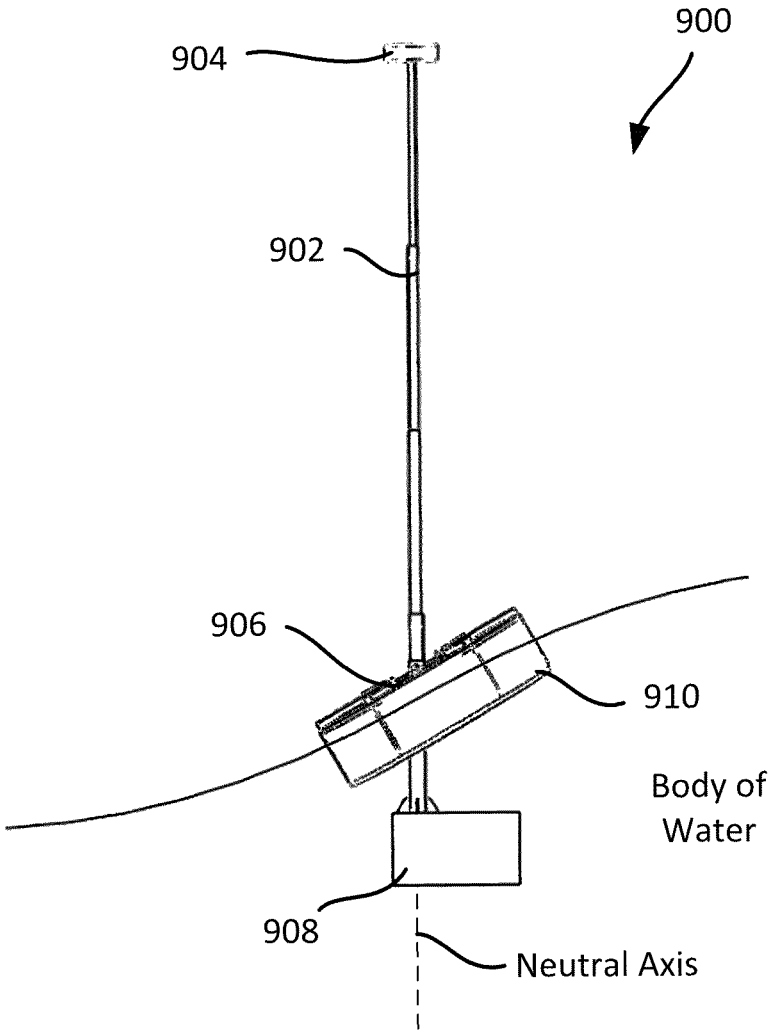
FIG. 9B illustrates an example of a mast stabilizing device that includes a mast coupled to a counterweight in an unevenly balanced configuration.

FIGS. 9A-9B illustrate an example of a mast stabilizing device that includes a shiftable counterweight. Specifically, FIG. 9A illustrates a mast stabilizing device with a mass 908 (e.g., counterweight) in a first position and FIG. 9B illustrates a mast stabilizing device with a mass 908 (e.g., counterweight) in a second lateral position (e.g., mass laterally shifted) from a neutral position.

As shown in FIG. 9A, the mast stabilizing device 900 includes a mast 902, a sensor 904, a pivot structure 906, a mass 908, and a platform 910. The mast 902 is coupled to the sensor 904. More specifically, a first portion (e.g., top portion) of the mast 902 is coupled to the sensor 904. The mast 902 is also coupled to the pivot structure 906. The pivot structure 906 may be a gimbal device in some implementations. In some implementations, the pivot structure 906 is configured to allow the mast 902 to pivot (e.g., rotate, swing) about a platform (e.g., platform 910). In some implementations, the pivot structure 906 is configured to allow a platform (e.g., platform 910) to pivot about the mast 902. The pivot structure 906 is coupled to the platform 910. The platform 910 may be a buoy. In some implementations, the platform 910 may be a moveable platform (e.g., vessel, ship, boat).

In some implementations, the mast 902 is configured to allow the mass 908 to be laterally shifted relative to the neutral position. Different implementations may position and configure the mass 908 differently. As shown in FIG. 9A, the mass 908 is in a first position. In the first position, the mass 908 is in a neutral position in some implementations. Specifically, the mass 908 is coupled to the mast 902 such that the center (e.g., center of gravity) of the mass 908 is vertically aligned with the axis of the mast 902. When the mass 908 is vertically aligned with the axis of the mast 902, the weight of the mass 908 is evenly distributed and balanced.

FIG. 9B illustrates the mast stabilizing device with a configurable mast 902 and the mass 908 in a second position. In some implementations, when the mass 908 is in the second position, the center (e.g., center of gravity) of the mass 908 has shifted laterally from the center of the mast 902. As shown in FIG. 9B, when the mast 902 is in the shifted position, the mass 908 is laterally shifted from a neutral position (e.g., axis of mast 902). Specifically, the mass 908 is unevenly distributed with respect to the axis of the mast 902. That is, more of the mass 902 is located on one side of the axis of the mast 902 than the other of the axis of the mast 902. Although FIG. 9B illustrates the configurable mast 902 in one shifted position (e.g., second position), in some implementations, the configurable mast 902 may have multiple shifted positions (e.g., third position, fourth position) that laterally shift the position of the mass 908 from a neutral position along different distances and/or angles. In some implementations, the shifting of the mass 908 may be done in real-time through the use of motors and/or actuators. However, different implementations may use different methods and mechanisms for laterally shifting the mass 908.

Figure 9C:
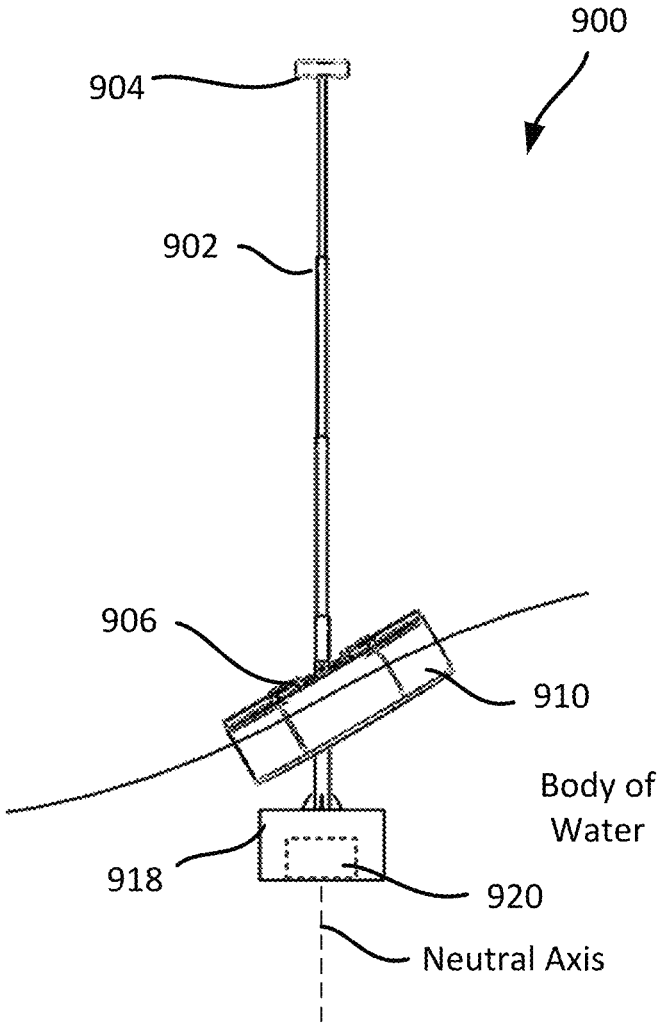
FIG. 9C illustrates an example of a mast stabilizing device that includes a mast coupled to an internal counterweight in an evenly balanced configuration.
Figure 9D:
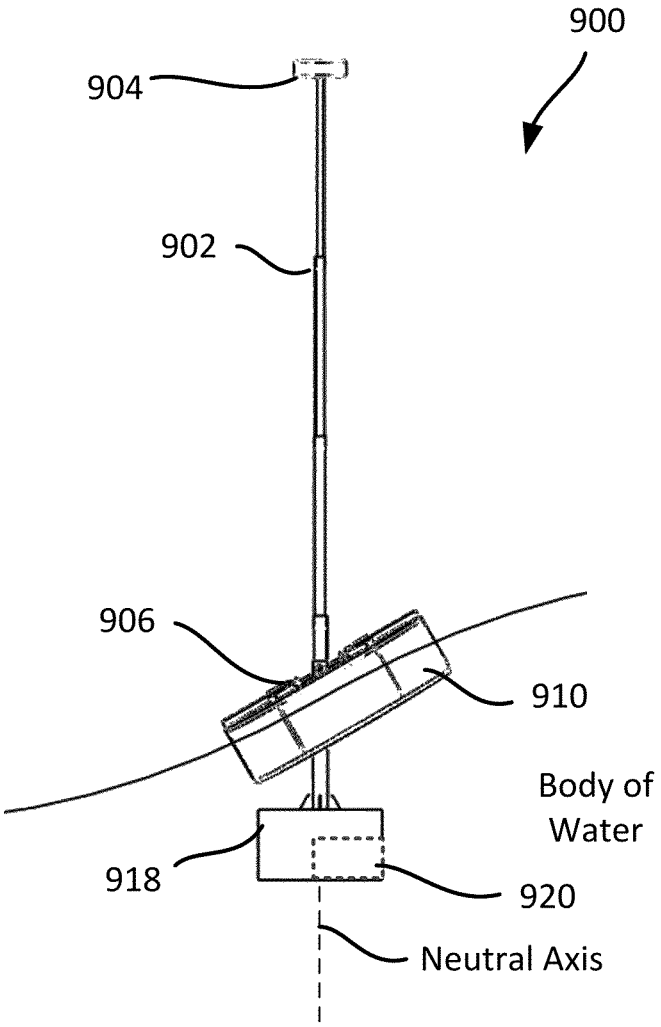
FIG. 9D illustrates an example of a mast stabilizing device that includes a mast coupled to an internal counterweight in an unevenly balanced configuration.
Figure 10A:
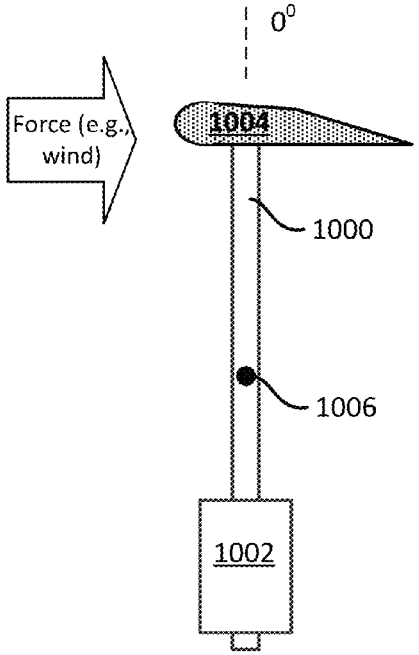
FIGS. 10A-10D illustrate examples of a mast that includes a lifting body and a counterweight mass at different tilted angles.
Figure 10B:
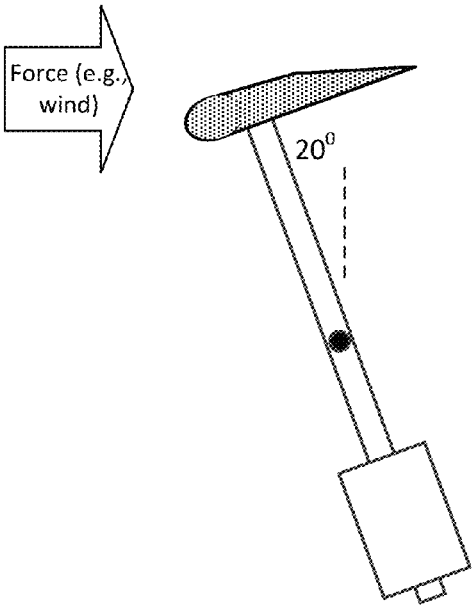
Figure 10C:
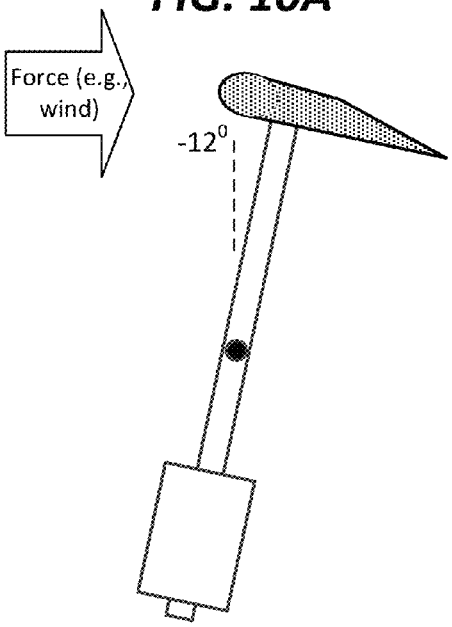
Figure 10D:
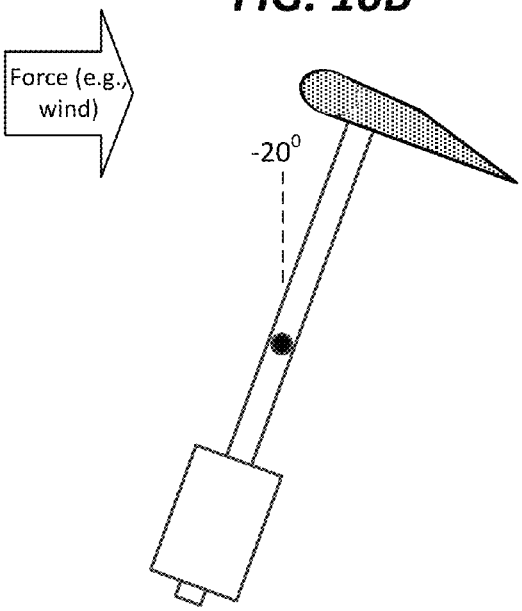
Figure 11A:
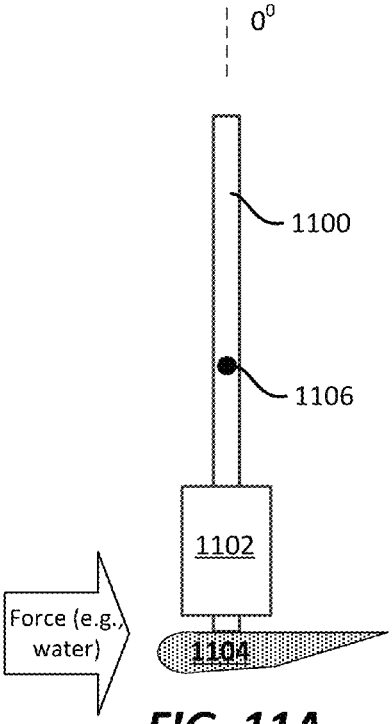
FIGS. 11A-11D illustrate examples of a mast that includes a lifting body and a counterweight mass at different tilted angles.
Figure 11B:
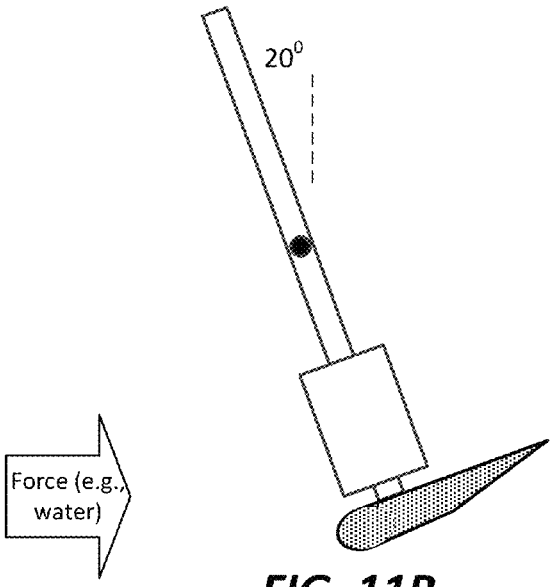
Figure 11C:
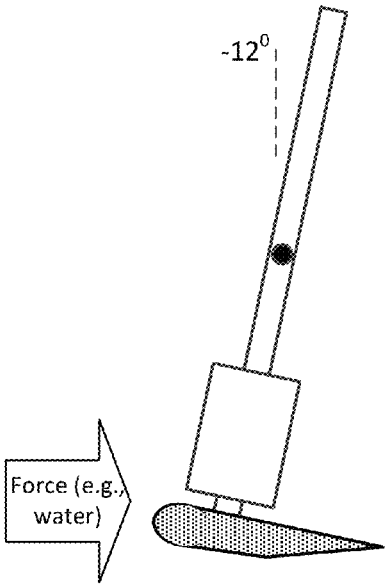
Figure 11D:
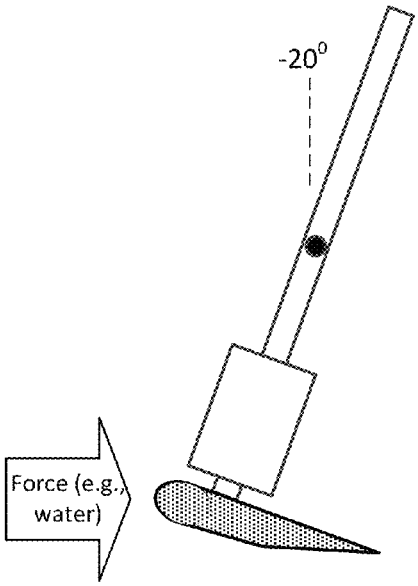

In some implementations, the shiftable counterweight may be differently implemented on a mast stabilizing device. FIGS. 9C-9D illustrate another example of a shiftable counterweight that may be implemented with a mast stabilizing device.

As shown in FIG. 9C, the mast stabilizing device 900 includes a mast 902, a sensor 904, a pivot structure 906, a mass 918, and a platform 910. The mast 902 includes a first portion 902*a* and a second portion 902*b*. The mast 902 is coupled to the sensor 904. More specifically, a first portion (e.g., top portion) of the mast 902 is coupled to the sensor 904. The mast 902 is also coupled to the pivot structure 906. The pivot structure 906 may be a gimbal device in some implementations. In some implementations, the pivot structure 906 is configured to allow the mast 902 to pivot (e.g., rotate, swing) about a platform (e.g., platform 910). In some implementations, the pivot structure 906 is configured to allow a platform (e.g., platform 910) to pivot about the mast 902. The pivot structure 906 is coupled to the platform 910. The platform 910 may be a buoy. In some implementations, the platform 910 may be a moveable platform (e.g., vessel, ship, boat).

As further shown in FIG. 9C, the mass 918 includes an internal mass 920. In some implementations, the mass 918 is a box that includes the internal mass 920. In some implementations, the mass 918 is fixed to the mast 902. Different implementations may use different objects for the internal mass 920. For example, the internal mass 920 may be a battery in some implementations. In some implementations, the mass 918 is configured to allow the internal mass 920 to be laterally shifted relative to a neutral position. In some implementations, shifting the position of the internal mass 920 affects the center of gravity of the mass 918. Thus, in some implementations, shifting the position of the internal mass 920 has the affect of effectively shifting the position of the mass 918 relative to the mast 902, even if the mass 918 remains fixed relative to the mast 902.

Different implementations may position and configure the internal mass 920 differently. As shown in FIG. 9C, the internal mass 920 is in a first position in the mass 918. In the first position, the internal mass 920 is in a neutral position in some implementations. Consequently, the mass 918 is also in a neutral position. Specifically, the mass 918 (and the internal mass 920) is coupled to the mast 902 such that the center (e.g., center of gravity) of the mass 908 is vertically aligned with the axis of the mast 902. When the mass 918 is vertically aligned with the axis of the mast 902, the weight of the mass 918 is evenly balanced in some implementations.

FIG. 9D illustrates the mast stabilizing device with a configurable mast 902 and the internal mass 920 in a second position. In some implementations, when the internal mass 920 is in the second position, the center (e.g., center of gravity) of the mass 918 has shifted laterally from the center of the mast 902. As shown in FIG. 9D, when the mast 902 is in the shifted position, the internal mass 920 and consequently the mass 918 is laterally shifted from a neutral position (e.g., axis of mast 902). Specifically, the mass 918 is unevenly distributed with respect to the axis of the mast 902. That is, more of the mass 918 (which includes the internal mass 920) is located on one side of the axis of the mast 902 than the other side of the axis of the mast 902. Although FIG. 9D illustrates the configurable mast 902 in one shifted position (e.g., second position), in some implementations, the configurable mast 902 may have multiple shifted positions (e.g., third position, fourth position) that laterally shift the position of the internal mass 920 and/or mass 918 from a neutral position along different distances and/or angles. In some implementations, the shifting of the internal mass 918 may be done in real-time through the use of motors and/or actuators. However, different implementations may use different methods and mechanisms for laterally shifting the internal mass 918.

Exemplary Mast Coupled to a Lifting Body

As mentioned above, a mast stabilizing device may be subject to wind force. Specifically, a mast of a mast stabilizing device may be subject to wind force. In some implementations, a lifting body may be coupled to a mast to counteract the wind force.

FIGS. 10A-10D illustrate an example of a mast that includes a lifting body and a counterweight mass. In some implementations, the mast of FIGS. 10A-10D may be implemented in the mast stabilizing device of FIGS. 4-9, or any mast stabilizing device of the present disclosure.

Specifically, FIGS. 10A-10D illustrate a mast 1000 that includes a counterweight mass 1002 and a lifting body 1004, where the mast 1000 is tilted at different angles along a pivot point 1006. In some implementations, the pivot point 1006 of the mast 1000 is a portion of the mast 1000 that is coupled to a pivot structure (e.g., gimbal device).

In some implementations, the lifting body 1004 provides different lift coefficients at different tilting angle of the mast 1000. A lift coefficient is a dimensionless coefficient that relates the lift generated by a lifting body (e.g., lifting mass), the dynamic pressure of the fluid flow (e.g., air, water) around the body, and a reference area associated with the body (e.g., lifting mass). In some implementations, the further the mast 1000 tilts away from a reference angle (e.g., 0 degrees), the greater the lift coefficient, which results in more lift. The lifting body 1004 is attached to the mast 1000 so that the center of the lift force is offset from the centerline of the mast 1000 thus creating a moment acting on the mast 1000. The moment created by the increased lift may offset (e.g., fully or partially offset) the force from the wind, which results in the dampening of the motion (e.g., tilting) of the mast 1000 and returning it to a vertical position in some implementations. FIGS. 10A-10D illustrate the mast 1000 respectively tilted at 0, 20, −12 and −20 degrees. It should be noted that the degrees listed are merely exemplary. Different designs of the lifting body will produce different resistance at different angles. In some implementations, the lifting body may be designed to limit the angle (e.g., maximum angle) at which the mast 1000 may tilt away from a vertical orientation. Such a maximum angle may be specific to the sensor coupled to the mast 1000 in some implementations.

It should also be noted that the lifting body 1004 is positioned above the pivot point 1006 and the counterweight mass 1002 is positioned below the pivot point 1006. In some implementations, the lifting body 1004 may be coupled to the mast 1000 in a different portion. For example, in some implementations, the lifting body 1004 may be positioned below the pivot point 1006. Such an instance is further described below in FIGS. 11A-11D. Moreover, in some implementations, the lifting body 1004 may be configured to have storage functionality. That is, in some implementations, the lifting body 1004 may be capable of storing different objects (e.g., sensor, transmitter).

FIGS. 11A-11D illustrate a mast 1100 that includes a counterweight mass 1102 and a lifting body 1104, where the mast 1100 is tilted at different angles along a pivot point 1106. FIGS. 11A-11D illustrate that both the counterweight mass 1102 and the lifting body 1104 are positioned below the pivot point 1106. In some implementations, both the counterweight mass 1102 and the lifting body 1104 may be configured to be submerged in water when coupled to a mast stabilizing device.

In some implementations, the lifting body 1104 provides different lift coefficients at different tilting angle of the mast 1100. In some implementations, the further the mast 1000 tilts away from a reference angle (e.g., 0 degrees), the greater the lift coefficient, which results in more lift. The lifting body is attached to the mast 1100 so that the center of the lift force is offset from the centerline of mast 1100 thus creating a moment acting on the mast 1000. The moment created by the increased lift may offset (e.g., fully or partially offset) the force from the wind/water, which results in the dampening of the motion (e.g., tilting) of the mast 1100 and returning it to a vertical position in some implementations. FIGS. 11A-11D illustrate the mast 1100 respectively tilted at 0, 20, −12 and −20 degrees. It should also be noted that in some implementations, the counterweight mass 1102 and the lifting body 1104 may be combined as one mass. In such instances only the lifting body 1104 may be coupled to the mast 1100. In this configuration, the lifting body 1104 is configured to provide both the counterweight and the lift coefficient resistance that acts as a dampener on the mast 1100, resulting in the reduction and/or prevention of the pendulation of the mast 1100, in some implementations. Moreover, in some implementations, the lifting body 1104 may be configured to have storage functionality. That is, in some implementations, the lifting body 1004 may be capable of storing different objects (e.g., battery).

Exemplary Mast Stabilizing Device that Includes a Constant Tension Device

Figure 12:
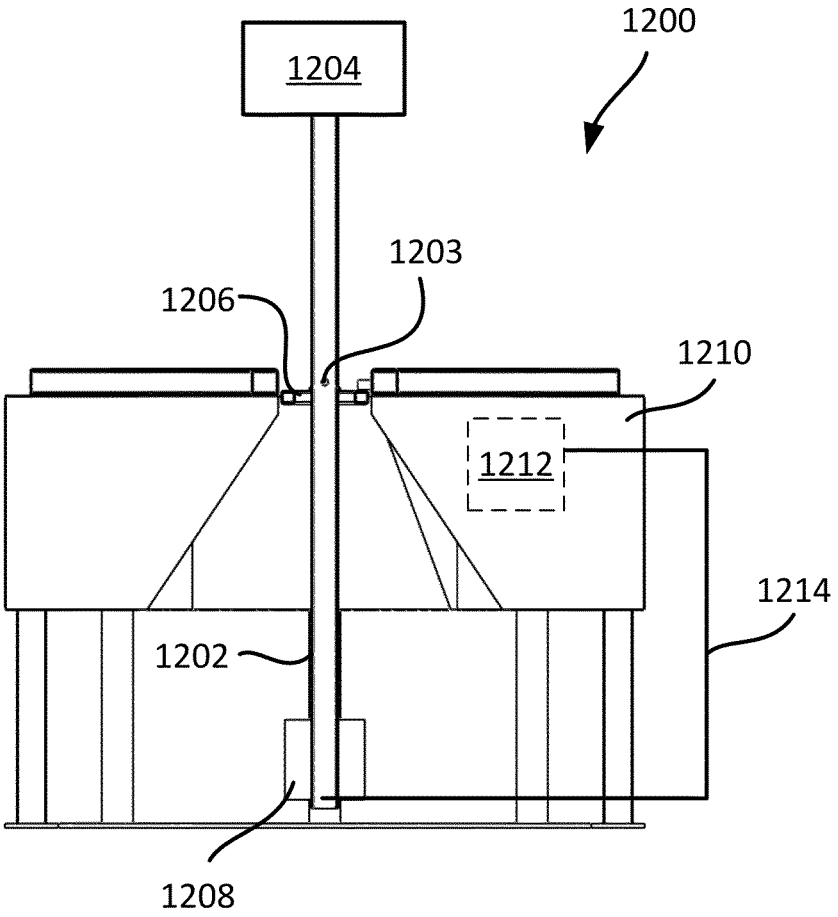
FIG. 12 illustrates an example of a mast stabilizing device that includes a constant tension winch.

FIG. 12 illustrates an example of a mast stabilizing device that includes a constant tension device (e.g., constant tension winch) may be used in some implementations. In some implementations, the constant tension device is a constant tension means. In some implementations, the mast stabilizing device may be used on a platform in a body of water (e.g., sea, ocean). In some implementations, the constant tension device may be configured to operate as a damping device.

As shown in FIG. 12, the mast stabilizing device 1200 includes a mast 1202, a sensor 1204, a pivot structure 1206, a mass 1208, and a platform 1210. The mast 1202 is coupled to the sensor 1204. More specifically, a first portion (e.g., top portion) of the mast 1202 is coupled to the sensor 1204. The mast 1202 is also coupled to the pivot structure 1206. The pivot structure 1206 may be a gimbal device in some implementations. In some implementations, the pivot structure 1206 is configured to allow the mast 1202 to pivot (e.g., rotate, swing) about a platform (e.g., platform 1210). In some implementations, the pivot structure 1206 is configured to allow a platform (e.g., platform 1210) to pivot about the mast 1202. The pivot structure 1206 is coupled to the platform 1210. In some implementations, the platform 1210 may be a moveable platform (e.g., vessel, ship, boat). The platform 1210 may be a buoy.

FIG. 12 also illustrates that the mast 1202 is coupled to a mass 1208. More specifically, a second portion (e.g., bottom portion) of the mast 1202 is coupled to the mass 1208. In some implementations, the mass 1208 is a counterweight to the sensor 1204. In some implementations, the mass 1208 is configured to be submerged in water when the mast stabilizing device 1200 is operational and/or positioned in a body of water (e.g., sea, ocean). Different implementations may use a mass 1208 with different shapes and sizes. In some implementations, the mass 1208 is designed and/or configured to provide optimum motion damping of the mast 1202.

The mast stabilizing device 1200 also includes a constant tension device 1212 (e.g., constant tension winch). The constant tension device 1212 is positioned on the platform 1210. It should be noted that the location and/or position of the constant tension device 1212 can be anywhere on the platform 1210 and that the location and/or position shown in FIG. 12 is merely exemplary. The constant tension device 1212 includes a cable 1214 that is coupled to the mast 1202. Specifically, a first portion of the cable 1214 is coupled to the constant device 1212, while a second portion of the cable 1214 is coupled to a portion of the mast 1202. In some implementations, the second portion of the cable 1214 may be coupled to the mass 1208. As shown in FIG. 12, a portion (e.g., second portion) of the cable 1214 is coupled to a lower portion of the mast 1202 that is below the pivot point 1203 of the mast 1202 (e.g., portion of the mast 1202 submerged in body of water). In some implementations, the constant tension device 1212 is configured to provide a force (e.g., tension) on the mast 1202 that counteracts a force (e.g., wind force) that may be applied on the mast 1202 (e.g., upper portion of the mast). It should be noted that the cable 1214 shown in FIG. 12 is merely a conceptual representation of a wire (e.g., string) that couple the mast 1202 and the device 1212. The actual path that the cable 1214 traverses in between the mast 1202 and the device 1212 may be different for different implementations.

Figure 13:
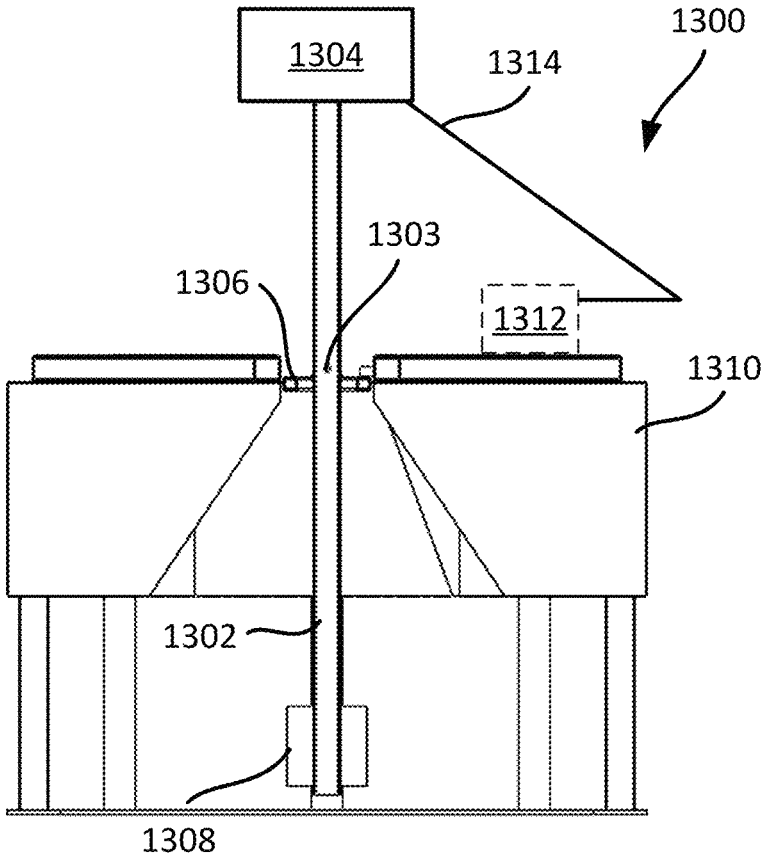
FIG. 13 illustrates another example of a mast stabilizing device that includes a constant tension winch.

In some implementations, the cable 1214 may be coupled to a different portion of the mast 1202. FIG. 13 illustrates an example of another mast stabilizing device that includes a constant tension device, where the cable is coupled to a different portion of the mast. As shown in FIG. 13, the mast stabilizing device 1300 includes a mast 1302, a sensor 1304, a pivot structure 1306, a mass 1308, a platform 1310, a constant tension device 1312, and a cable 1314.

The mast stabilizing device 1300 is similar to the mast stabilizing device 1200 of FIG. 12, except that the cable is coupled to a different portion of the mast. Specifically, FIG. 13 illustrates that one portion (e.g., first portion) of the cable 1314 is coupled to the constant tension device 1312, while another portion (e.g., second portion) of the cable 1314 is coupled to an upper portion of the mast 1302. In particular, the other portion of the cable 1314 is coupled to a portion of the mast 1302 that is above the pivot point 1303 of the mast 1302 (e.g., above the pivot structure 1306). In some implementations, the constant tension device 1312 is configured to provide a force (e.g., tension) on the mast 1302 that counteracts a force (e.g., wind force) that may be applied on the mast 1302 (e.g., upper portion of the mast). It should be noted that the location and/or position of the constant tension device 1312 can be anywhere on the platform 1310 and that the location and/or position shown in FIG. 13 is merely exemplary. It should also be noted that the cable 1314 shown in FIG. 13 is merely a conceptual representation of a wire (e.g., string) that couple the mast 1302 and the device 1312. The actual path that the cable 1314 traverses in between the mast 1302 and the device 1312 may be different for different implementations.

Exemplary Mast Stabilizing Device that Includes Deflectors

Figure 14:
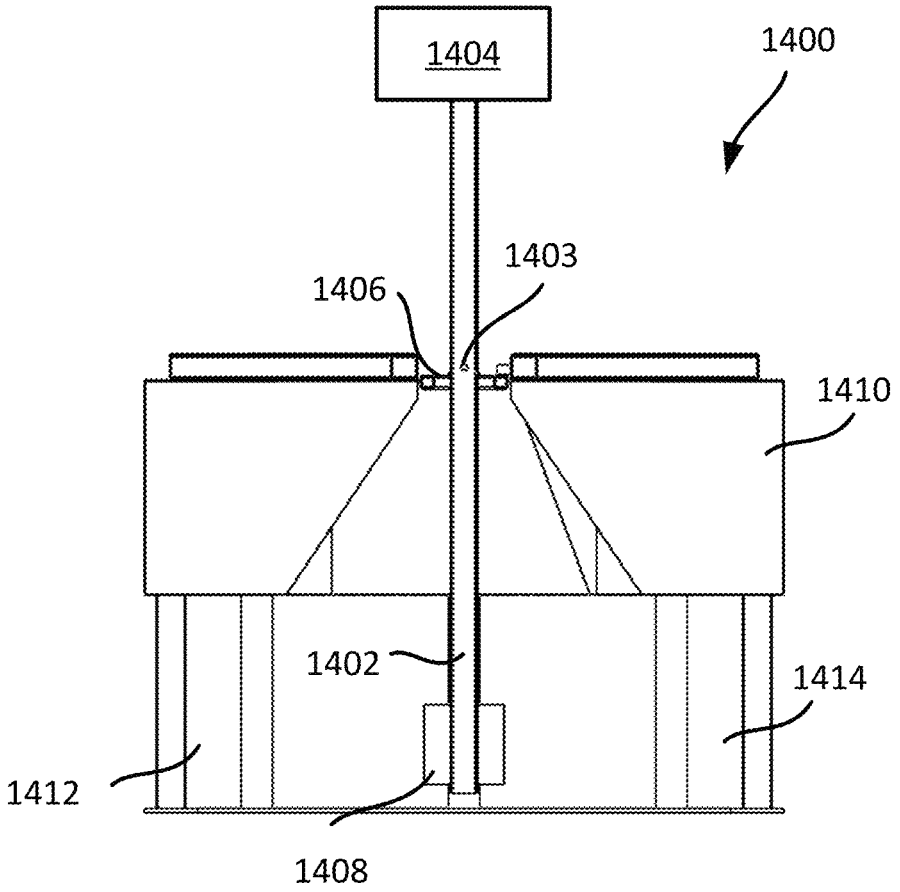
FIG. 14 illustrates an example of a mast stabilizing device that includes at least one deflector.

FIG. 14 illustrates an example of a mast stabilizing device that includes deflectors (e.g., deflecting means). In some implementations, the mast stabilizing device may be used on a platform in a body of water (e.g., sea, ocean).

As shown in FIG. 14, the mast stabilizing device 1400 includes a mast 1402, a sensor 1404, a pivot structure 1406, a mass 1408, a platform 1410, a first deflector 1412 and a second deflector 1414. The mast 1402 is coupled to the sensor 1404. More specifically, a first end portion (e.g., top portion) of the mast 1402 is coupled to the sensor 1404. The mast 1402 is also coupled to the pivot structure 1406. The pivot structure 1406 may be a gimbal device in some implementations. In some implementations, the pivot structure 1406 is configured to allow the mast 1402 to pivot (e.g., rotate, swing) about a platform (e.g., platform 1410). In some implementations, the pivot structure 1406 is configured to allow a platform (e.g., platform 1410) to pivot about the mast 1402. The pivot structure 1406 is coupled to the platform 1410. In some implementations, the platform 1410 may be a moveable platform (e.g., vessel, ship, boat). The platform 1410 may be a buoy.

FIG. 14 also illustrates two deflectors 1412-1414 coupled to the platform 1410. In some implementations, the first and second deflectors 1412-1414 are coupled to the platform 1410 such that the first and second deflectors 1412-1414 are submerged (e.g., partially or fully submerged) in the body of water when the platform 1410 is on the body of water. In some implementations, the first and second deflectors 1412-1414 are configured to align the platform 1410 and/or the mast stabilizing device 1400 along a current in the body of water in some implementations. In some implementations, only one deflector or more than two deflectors may be coupled to the platform 1410 to align the platform 1410 and/or the mast stabilizing device 1400. In some implementations, the deflectors may encircle the entire platform. In some implementations, the mast stabilizing device 1400 may be coupled to an anchor (not shown). In some implementations, when the mast stabilizing device 1400 is coupled to such an anchor, a force by the anchor may be used to align the platform 1410 and/or the mast stabilizing device 1400 along a current in the body of water.

Exemplary Mast Stabilizing Device that Includes Adjustable Damping Device

Figure 15:
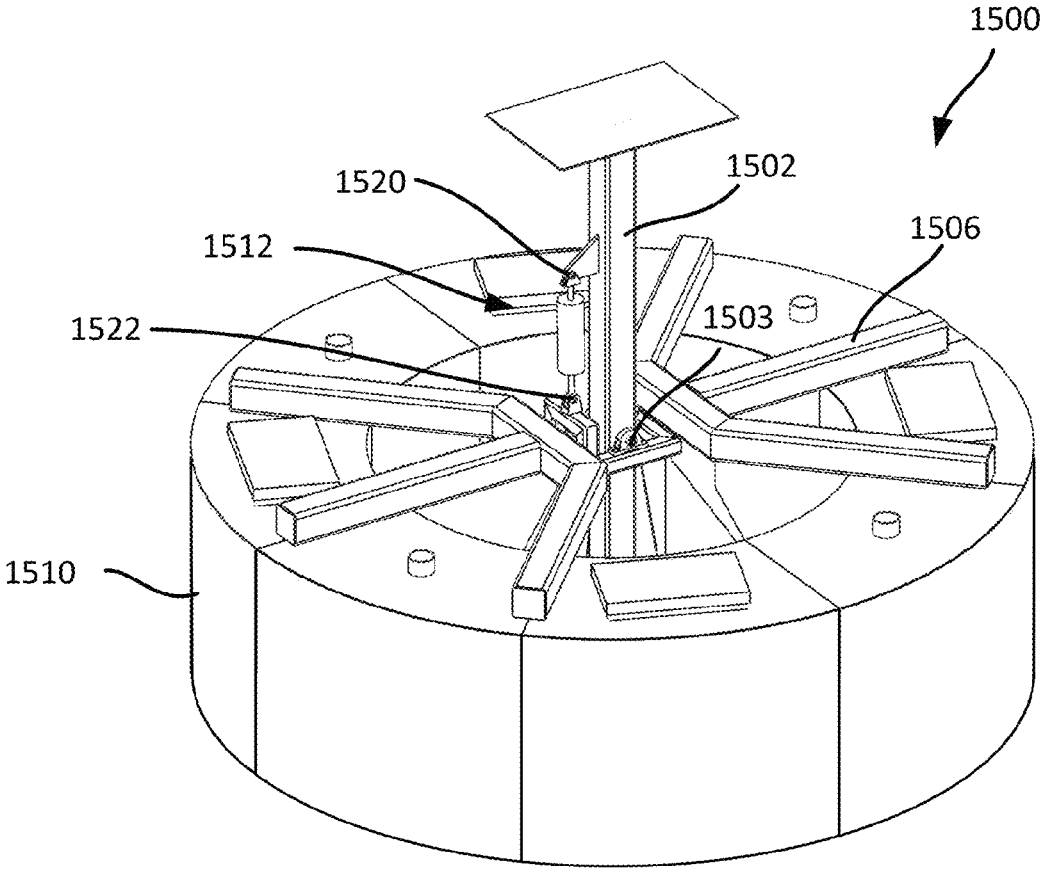
FIG. 15 illustrates an angled view of an example of a mast stabilizing device that includes an adjustable damping device.
Figure 16:
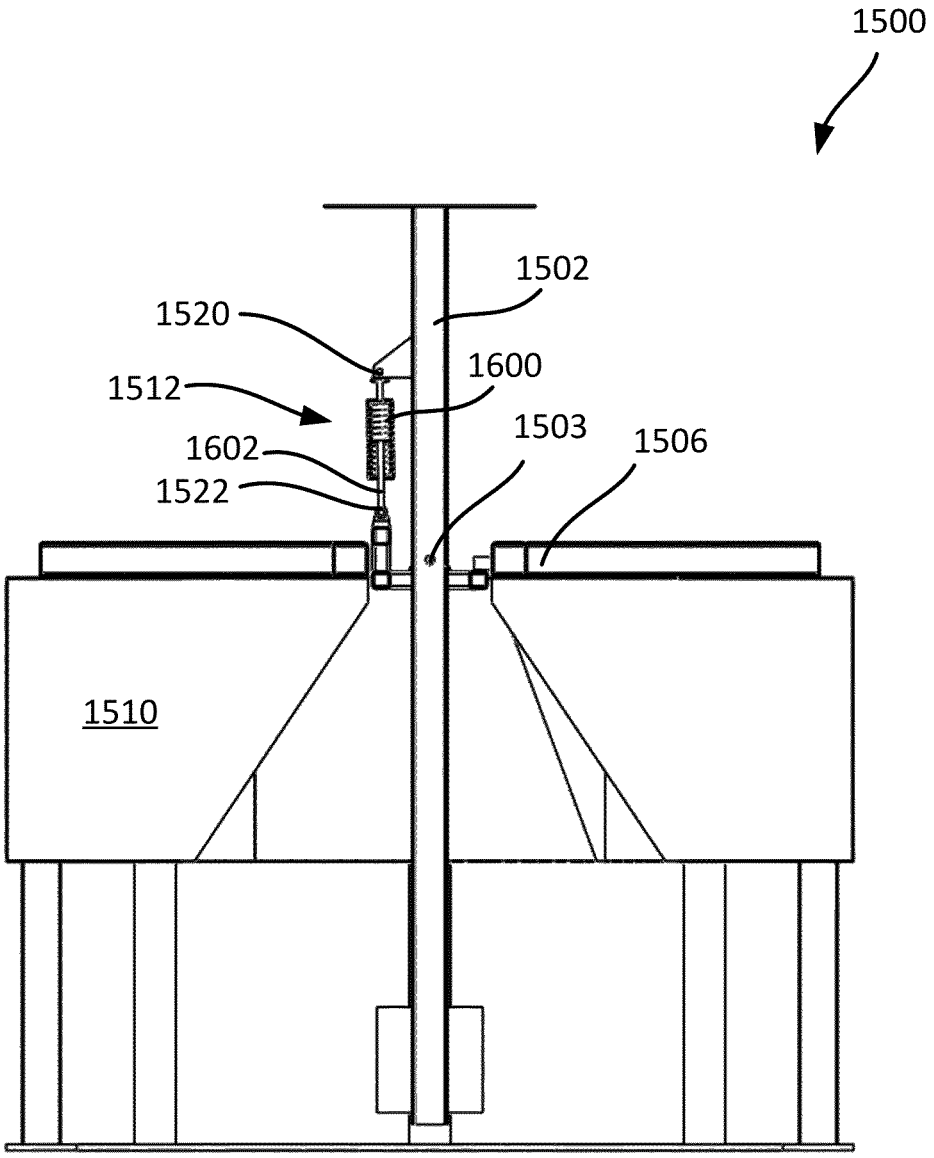
FIG. 16 illustrates a profile view of an example of a mast stabilizing device that includes an adjustable damping device.
Figure 17:
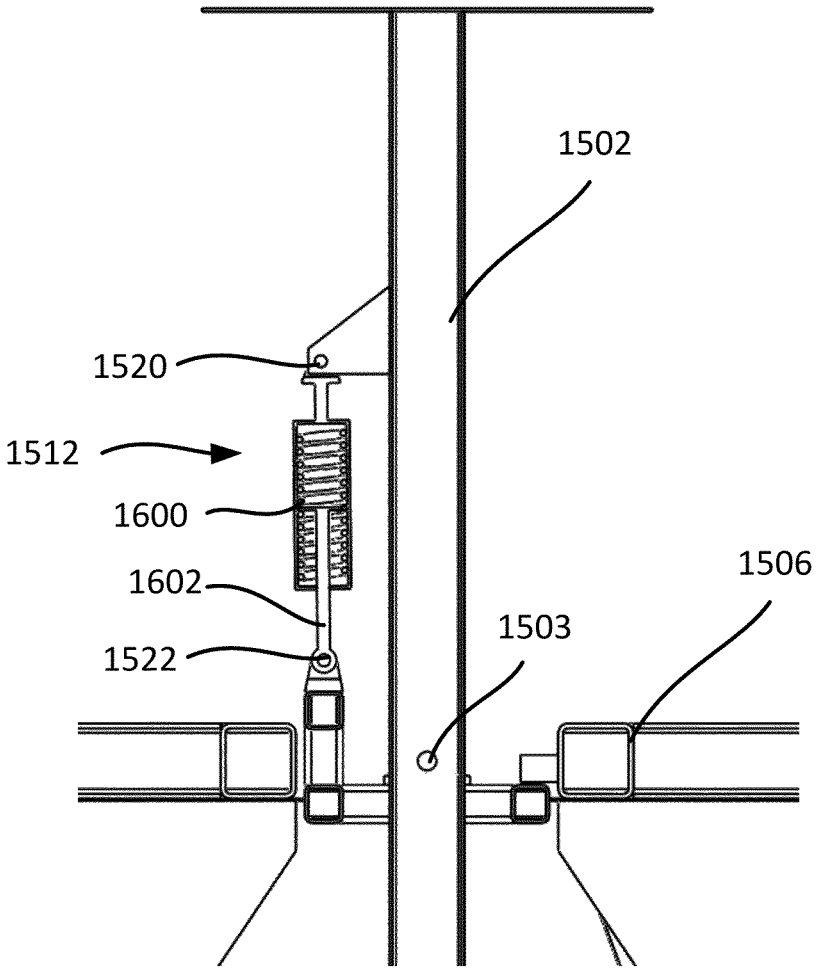
FIG. 17 illustrates a close up profile view of an example of a mast stabilizing device that includes an adjustable damping device.

FIGS. 15-17 illustrate an example of a mast stabilizing device that includes an adjustable damping device. Specifically, FIG. 15 illustrates a partial angled view of a mast stabilizing device, FIG. 16 illustrates a profile view of the mast stabilizing device, and FIG. 17 illustrates a close up profile view of the mast stabilizing device near a pivot structure. In some implementations, the mast stabilizing device may be used on a platform in a body of water (e.g., sea, ocean).

As shown in FIG. 15, the mast stabilizing device 1500 includes a mast 1502, a pivot structure 1506, a platform 1510, and an adjustable damping device 1512. The adjustable damping device 1512 includes a spring (not visible). The adjustable damping device 1512 is coupled to the mast 1502 through a first hinge 1520. The adjustable damping device 1512 is coupled to the pivot structure 1506 through a second hinge 1522. In some implementations, the mast 1502 may pivot about a pivot point 1503. The mast 1502 may be coupled to a sensor (not shown), and/or other devices in some implementations. The mast 1502 is also coupled to the pivot structure 1506. The pivot structure 1506 may be a gimbal device in some implementations. In some implementations, the pivot structure 1506 is configured to allow the mast 1502 to pivot (e.g., rotate, swing) about a platform (e.g., platform 1510). In some implementations, the pivot structure 1506 is configured to allow a platform (e.g., platform 1510) to pivot about the mast 1502. The pivot structure 1506 is coupled to the platform 1510. In some implementations, the platform 1510 may be a moveable platform (e.g., vessel, ship, boat). The platform 1510 may be a buoy.

The adjustable damping device 1512 is coupled to the pivot structure 1506 and the mast 1502 through hinges 1520-1522. In some implementations, the adjustable spring 1512 is configured to dampen/limit/restrict the motion/swinging of the mast 1502 due to an external force on the mast (e.g., wind force). In some implementations, a weather vane may be coupled to the mast 1502 and/or the platform 1510 in order to align the mast 1502 and/or the platform 1510 to the flow/direction of the wind. In some implementations, multiple adjustable springs may be used in order to provide dampening of the swinging motion of the mast 1502 along different directions. In some implementations, the damping device 1512 is adjustable by using springs with different lengths, windings, and/or materials. Moreover, the damping device 1512 may be adjustable by using and/or specifying different internal pressures in the damping device 1512. The damping device 1512 is coupled to the mast 1502 through a first hinge 1520. The damping device 1512 is coupled to the pivot structure 1506 through a second hinge 1522.

FIG. 16 illustrates a profile view of the mast stabilizing device of FIG. 15. As shown in FIG. 16 the mast stabilizing device 1500 includes the mast stabilizing device 1500 includes the mast 1502, the pivot structure 1506, the platform 1510, and the adjustable damping device 1512. The adjustable damping device 1512 includes a spring 1600 and a piston 1602. The adjustable damping device 1512 is coupled to the mast 1502 through the first hinge 1520. The adjustable damping device 1512 is coupled to the pivot structure 1506 through the second hinge 1522. In some implementations, the mast 1502 may pivot about a pivot point 1503. The mast 1502 may be coupled to a sensor (not shown), and/or other devices in some implementations. The mast 1502 is also coupled to the pivot structure 1506.

FIG. 17 illustrates a close up profile view of the mast stabilizing device of FIG. 15. As shown in FIG. 17, the adjustable damping device 1512 includes the spring 1600 and the piston 1602. The adjustable damping device 1512 is coupled to the mast 1502 through the first hinge 1520. The adjustable damping device 1512 is coupled to the pivot structure 1506 through the second hinge 1522. Specifically, the piston 1602 of the adjustable damping device 1512 is coupled to the pivot structure 1506 through the second hinge 1522.

Exemplary Mast Stabilizing Device that Includes Carriage Springs

Figure 18:
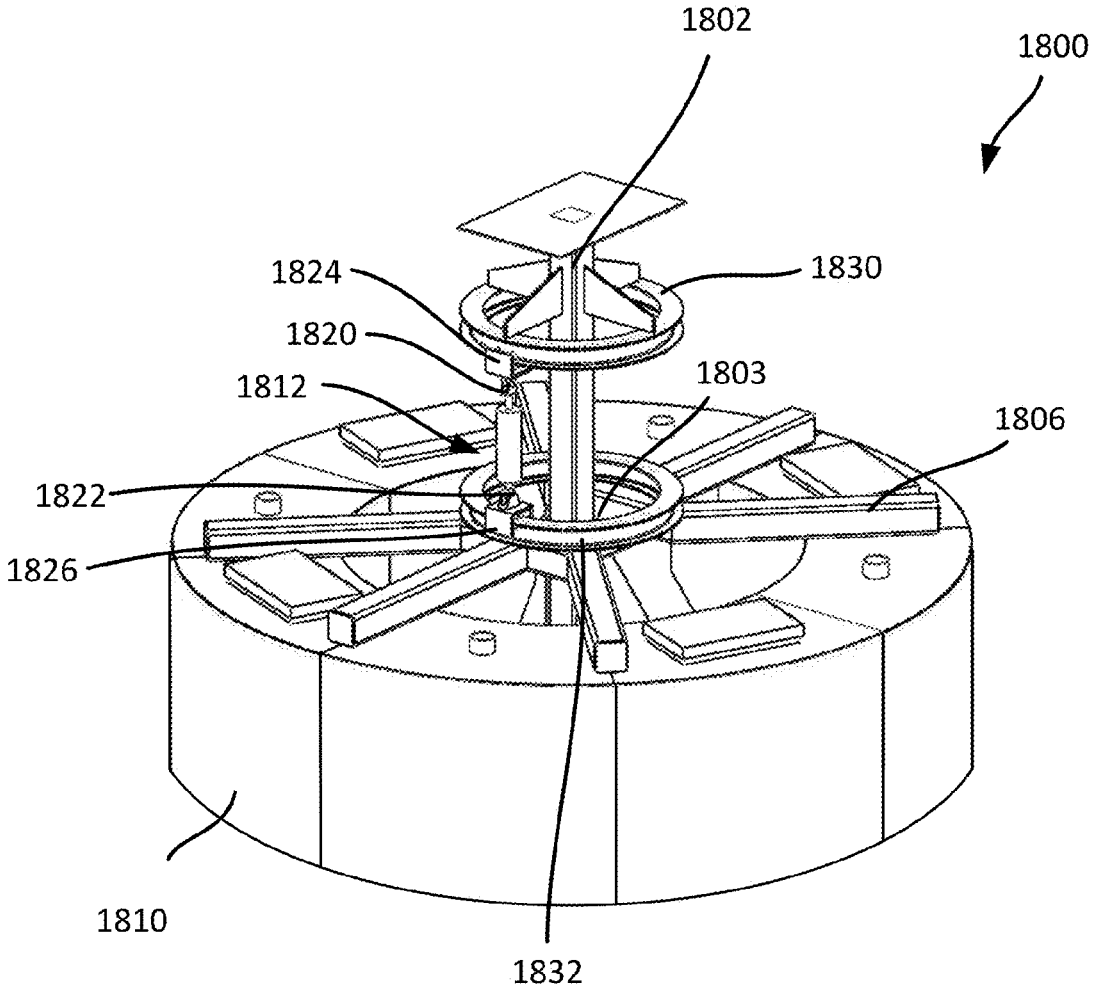
FIG. 18 illustrates an angled view of an example of a mast stabilizing device that includes a carriage spring.
Figure 19:
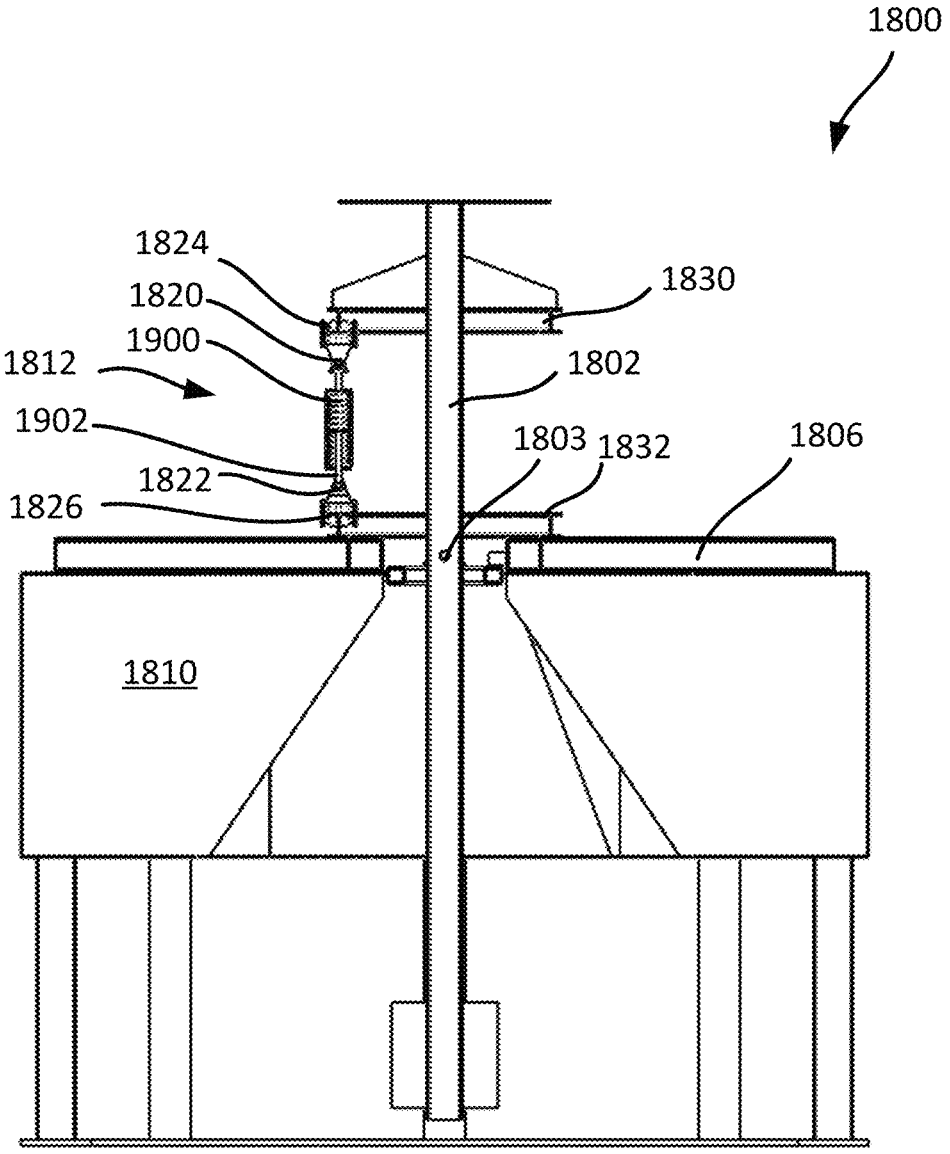
FIG. 19 illustrates a profile view of an example of a mast stabilizing device that includes a carriage spring.
Figure 20:
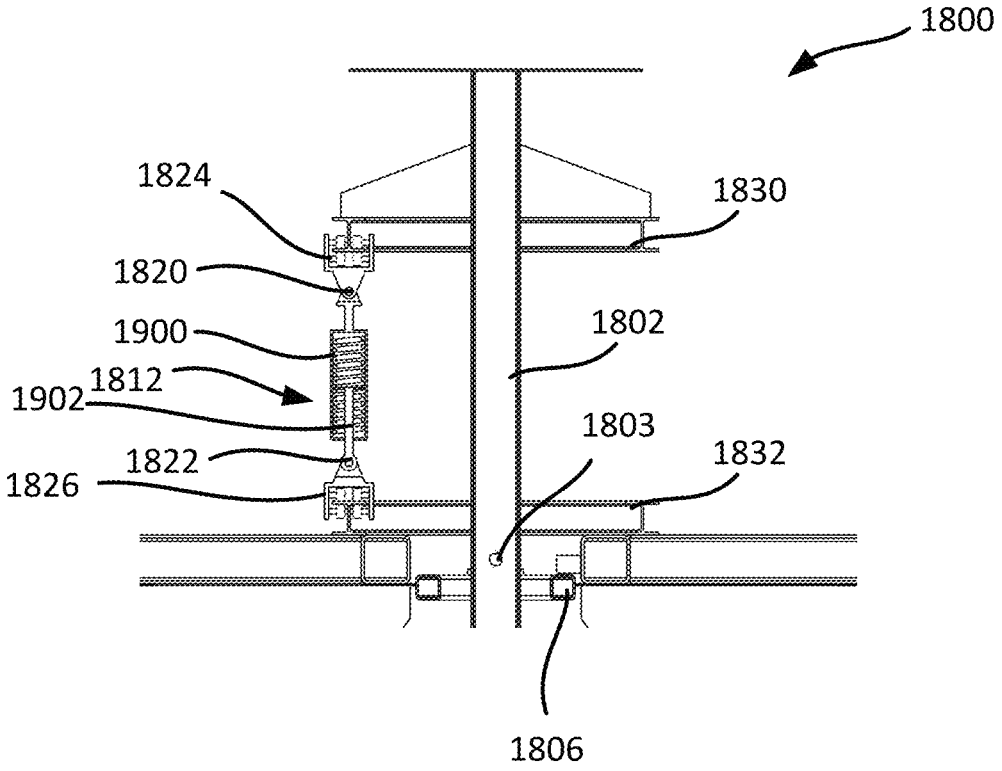
FIG. 20 illustrates a close up profile view of an example of a mast stabilizing device that includes a carriage spring.

FIGS. 18-20 illustrate an example of a mast stabilizing device that includes carriage spring devices. Specifically, FIG. 18 illustrates a partial angled view of a mast stabilizing device, FIG. 19 illustrates a profile view of the mast stabilizing device, and FIG. 20 illustrates a close up profile view of the mast stabilizing device near a pivot structure. In some implementations, the mast stabilizing device may be used on a platform in a body of water (e.g., sea, ocean).

As shown in FIG. 18, the mast stabilizing device 1800 includes a mast 1802, a pivot structure 1806, a platform 1810, and a carriage spring device 1812. In some implementations, the mast 1802 may pivot about a pivot point 1803. The mast 1802 may be coupled to a sensor (not shown), and/or other devices in some implementations. The mast 1802 is also coupled to the pivot structure 1806. The pivot structure 1806 may be a gimbal device in some implementations. In some implementations, the pivot structure 1806 is configured to allow the mast 1802 to pivot (e.g., rotate, swing) about a platform (e.g., platform 1810). In some implementations, the pivot structure 1806 is configured to allow a platform (e.g., platform 1810) to pivot about the mast 1802. The pivot structure 1806 is coupled to the platform 1810. The platform 1810 may be a buoy. In some implementations, the platform 1810 may be a moveable platform (e.g., vessel, ship, boat, buoy). The adjustable spring 1812 is coupled to the pivot structure 1806 and the mast 1802. In some implementations, the adjustable spring 1812 is configured to dampen/limit/restrict the motion/swinging of the mast 1802 due to an external force on the mast (e.g., wind force). In some implementations, a weather vane may be coupled to the mast 1802 and/or the platform 1810 in order to align the mast 1802 and/or the platform 1810 to the flow/direction of the wind. In some implementations, multiple springs may be used in order to provide dampening of the swinging motion of the mast 1802 along different directions.

FIG. 18 also illustrates a first rail 1830 and a second rail 1832. The first rail 1830 is coupled to the mast 1802. The second rail 1832 is coupled to the pivot structure 1806. The carriage spring device 1812 includes a spring (not visible), a piston, a first hinge 1820, a second hinge 1822, a first rail coupler 1824, and a second rail coupler 1826. The carriage spring device 1812 is coupled to the mast 1802 through the first hinge 1820, the first rail coupler 1824, and the first rail 1830. The carriage spring device 1812 is coupled to the pivot structure 1806 through the second hinge 1822, the second rail coupler 1826, and the second rail 1832. In some implementations, the carriage spring device 1812 allows the spring/damper to act off-axis. In some implementations, the spring/damper is only active when the mast 1802 pivots about pivot 1803. In some implementations, the carriage spring device 1812 will rotate about the axis of the mast 1802 to the area where the gap between the carriage rails (e.g., first and second rails 1830-1832) is either the largest or the smallest depending on whether the spring is providing a compression or a tensile force.

In some implementations, the carriage spring device 1812 is less necessary when the platform 1810 weathervanes to a force applied from a single direction. However, there is the condition where the wind current and the water currents are not aligned, which will result in both the pivot point 1803 and the pivot structure 1806 having some deflection. In some implementations, the carriage spring device 1812 provides for this case where the applied forces do not align with a single pivot.

FIG. 19 illustrates a profile view of the mast stabilizing device of FIG. 18. As shown in FIG. 19 the mast stabilizing device 1800 includes the mast 1802, the pivot structure 1806, the platform 1810, and the carriage spring device 1812. The carriage spring device 1812 includes a spring 1900 and a piston 1902.

FIG. 20 illustrates a close up profile view of the mast stabilizing device of FIG. 18. As shown in FIG. 20, the carriage spring device 1812 includes the spring 1900 and the piston 1902. The carriage spring device 1812 is coupled to the mast 1802 through the first hinge 1820, the first rail coupler 1824, and the first rail 1830. The carriage spring device 1812 is coupled to the pivot structure 1806 through the piston 1902, the second hinge 1822, the second rail coupler 1826, and the second rail 1832.

One or more of the elements, steps, features, and/or functions illustrated in FIGS. 4, 5, 6A-6B, 7A-7B, 8A-8B, 9A-9D, 10A-10D, 11A-11D, 12, 13, 14, 15, 16, 17, 18, 19 and/or 20 may be rearranged and/or combined into a single component, step, feature or function or embodied in several components, steps, or functions. Additional elements, components, steps, and/or functions may also be added without departing from the invention. FIGS. 4, 5, 6A-6B, 7A-7B, 8A-8B, 9A-9D, 10A-10D, 11A-11D, 12, 13, 14, 15, 16, 17, 18, 19 and/or 20 illustrates various damping means, mechanisms, methods and/or devices (e.g., mass, adjustable spring, carriage spring device, constant tension device). In some implementations, several damping means, mechanisms, methods and/or devices can be combined to provide a damping means, mechanisms, methods and/or devices with particular design objectives. For example, some implementations may include all of various devices, damping means, mechanisms, and methods, while other implementations may include some of the various devices, damping means, mechanisms, and methods.

The word "exemplary" is used herein to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other.

The various features of the invention described herein can be implemented in different systems without departing from the invention. It should be noted that the foregoing aspects of the disclosure are merely examples and are not to be construed as limiting the invention. The description of the aspects of the present disclosure is intended to be illustrative, and not to limit the scope of the claims. As such, the present teachings can be readily applied to other types of devices, apparatuses and many alternatives, modifications, and variations will be apparent to those skilled in the art.

What is claimed is:

1. A mast stabilizing device comprising:

a mast comprising a first portion and a second portion, wherein the mast is an extendable mast that is configurable to be in a plurality of positions, the plurality of positions comprising an extended position and a retracted position;

a pivot structure coupled to the mast, the pivot structure configured to allow the mast to pivot in the mast stabilizing device, the mast coupled to the pivot structure so as to pivot along a pivot portion of the mast;

a mass coupled to the second portion of the mast, the mass configured to counteract a force applied to the first portion of the mast;

a sensor coupled to the first portion of the mast, wherein the mast is configured to position the sensor further away from the pivot portion when the mast is in the extended position relative to the retracted position; and a platform coupled to the pivot structure, the platform configured to operate on a body of water.

2. The mast stabilizing device of claim 1, wherein the mass is configured to operate as a damping device when the mass is immersed in the body of water, the damping device configured to limit a swinging motion of the mast.

3. The mast stabilizing device of claim 1 further comprising a lifting body coupled to the mast, the lifting body configured to counteract force from wind on the mast.

4. The mast stabilizing device of claim 1 further comprising a constant tension device coupled to the mast through a cable, the constant tension device and the cable configured to counteract force from one of at least wind and/or water on the mast.

5. The mast stabilizing device of claim 1 further comprising an adjustable spring coupled to the pivot structure and the mast, the adjustable spring configured to operate as a damping device that limits a swinging motion of the mast.

6. The mast stabilizing device of claim 1 further comprising at least one deflector coupled to the platform, the deflector configured to align the platform along a current in the body of water.

7. The mast stabilizing device of claim 1 further comprising a damping device comprising a spring, the damping device coupled to the mast and the pivot structure.

8. The mast stabilizing device of claim 1 further comprising a carriage spring device comprising a spring, the carriage spring coupled to the mast and the pivot structure.

9. The mast stabilizing device of claim 1, wherein the mass is configured to be laterally moveable relative to the mast.

10. The mast stabilizing device of claim 1, wherein the mass includes an internal mass, the internal mass configured to be laterally moveable relative to the mast.

11. The mast stabilizing device of claim 1, wherein the mast is a configurable mast that comprises a pivot joint that is configured to allow at least a portion of the configurable mast to bend and/or be adjusted, the configurable mast is configured to be able to be adjusted in order to shift the mass in a different position relative to the mast.

12. The mast stabilizing device of claim 1, wherein the mass is coupled to the mast such that the mass is laterally shifted relative to the mast.

13. The mast stabilizing device of claim 1, wherein the pivot structure is a gimbal device.

14. The mast stabilizing device of claim 1, wherein the platform is one of at least a surface buoy, and/or a moveable surface vessel.

15. An apparatus:

a mast comprising a first portion and a second portion, wherein the mast is an extendable mast that is configurable to be in a plurality of positions, the plurality of positions comprising an extended position and a retracted position;

a pivot means coupled to the mast, the pivot means configured to allow the mast to pivot in the mast stabilizing device, the mast coupled to the pivot means so as to pivot along a pivot portion of the mast;

a counterweight means coupled to the second portion of the mast, the counterweight means configured to counteract a force applied to the first portion of the mast;

a sensor coupled to the first portion of the mast, wherein the mast is configured to position the sensor further away from the pivot portion when the mast is in the extended position relative to the retracted position; and a platform coupled to the pivot means, the platform configured to operate on a body of water.

16. The apparatus of claim 15, wherein the counterweight means is configured to operate as a damping device when the counterweight means is immersed in the body of water, the damping device configured to limit a swinging motion of the mast.

17. The apparatus of claim 15 further comprising a lifting means coupled to the mast, the lifting means configured to counteract force from wind on the mast.

18. The apparatus of claim 15 further comprising a constant tension means coupled to the mast through a cable, the constant tension means and the cable configured to counteract force from one of at least wind and/or water on the mast.

19. The apparatus of claim 15 further comprising an adjustable spring means coupled to the pivot means and the mast, the adjustable spring means configured to operate as a damping means that limits a swinging motion of the mast.

20. The apparatus of claim 15 further comprising at least one deflecting means coupled to the platform, the deflecting means configured to align the platform along a current in the body of water.

21. The apparatus of claim 15 further comprising a damping means comprising a spring, the damping means coupled to the mast and the pivot means.

22. The apparatus of claim 15 further comprising a carriage spring means comprising a spring, the carriage spring means coupled to the mast and the pivot means.

23. The apparatus of claim 15, wherein the counterweight means is configured to be laterally moveable relative to the mast.

24. The apparatus of claim 15, wherein the counterweight means includes an internal mass, the internal mass configured to be laterally moveable relative to the mast.

25. The apparatus of claim 15, wherein the mast is a configurable mast that comprises a pivot joint means that is configured to allow at least a portion of the configurable mast to bend and/or be adjusted, the configurable mast is configured to be able to be adjusted in order to shift the counterweight means in a different position relative to the mast.

26. The apparatus of claim 15, wherein the counterweight means is coupled to the mast such that the counterweight means is laterally shifted relative to the mast.

27. The apparatus of claim 15, wherein the pivot means is a gimbal device.

28. The apparatus of claim 15, wherein the platform is one of at least a surface buoy, and a moveable surface vessel.

29. An apparatus:

a mast comprising a first portion and a second portion;

a pivot means coupled to the mast, the pivot means configured to allow the mast to pivot in the mast stabilizing device, the mast coupled to the pivot means so as to pivot along a pivot portion of the mast;

a carriage spring means comprising a spring, the carriage spring means coupled to the mast and the pivot means;

a first rail coupled to the mast;

a second rail coupled to the pivot means;

a first rail coupler coupled to the first rail;

a second rail coupler coupled to the second rail;

a counterweight means coupled to the second portion of the mast, the counterweight means configured to counteract a force applied to the first portion of the mast; and a platform coupled to the pivot means, the platform configured to operate on a body of water.

30. The apparatus of claim 29, wherein the counterweight means is configured to operate as a damping device when the counterweight means is immersed in the body of water, the damping device configured to limit a swinging motion of the mast.

31. A device comprising:

a mast comprising a first portion and a second portion;

a pivot structure coupled to the mast, the pivot structure configured to allow the mast to pivot in the mast stabilizing device, the mast coupled to the pivot structure so as to pivot along a pivot portion of the mast;

a carriage spring device comprising a spring, the carriage spring coupled to the mast and the pivot structure;

a first rail coupled to the mast;

a second rail coupled to the pivot structure;

a first rail coupler coupled to the first rail;

a second rail coupler coupled to the second rail;

a mass coupled to the second portion of the mast, the mass configured to counteract a force applied to the first portion of the mast; and a platform coupled to the pivot structure, the platform configured to operate on a body of water.

32. The device of claim 31, wherein the mass is configured to operate as a damping device when the mass is immersed in the body of water, the damping device configured to limit a swinging motion of the mast.

* * * * *